US012005311B2

(12) United States Patent
Goldberg et al.

(10) Patent No.: US 12,005,311 B2
(45) Date of Patent: Jun. 11, 2024

(54) EXERCISE DEVICES

(71) Applicant: Serge Goldberg, Ambler, PA (US)

(72) Inventors: Serge Goldberg, Ambler, PA (US); Viktor Kapiliovich, Southampton, PA (US)

(73) Assignee: Serge Goldberg, Ambler, PA (US)

( * ) Notice: Subject to any disclaimer, the term of this patent is extended or adjusted under 35 U.S.C. 154(b) by 0 days.

(21) Appl. No.: 18/534,007

(22) Filed: Dec. 8, 2023

(65) Prior Publication Data

US 2024/0100389 A1 Mar. 28, 2024

Related U.S. Application Data

(63) Continuation-in-part of application No. PCT/US2022/032444, filed on Jun. 7, 2022.

(60) Provisional application No. 63/208,154, filed on Jun. 8, 2021.

(51) Int. Cl.
*A63B 23/035* (2006.01)
*A63B 21/00* (2006.01)

(52) U.S. Cl.
CPC .... *A63B 23/03541* (2013.01); *A63B 21/0004* (2013.01); *A63B 21/00185* (2013.01); *A63B 21/151* (2013.01); *A63B 21/4027* (2015.10); *A63B 21/4045* (2015.10)

(58) Field of Classification Search
CPC ..... A63B 21/0004; A63B 21/00185; A63B 21/4027; A63B 21/4045; A63B 69/18; A63B 69/182; A63B 69/187
See application file for complete search history.

(56) References Cited

U.S. PATENT DOCUMENTS 4,900,013 A * 2/1990 Rodgers, Jr. ..... A63B 69/06 482/72
5,792,031 A * 8/1998 Alton ..... G09B 19/0038 482/901
6,168,554 B1 * 1/2001 Berg ..... A63B 69/06 482/138
8,961,373 B2 * 2/2015 Halver ..... A63B 21/4047 482/52

(Continued)

FOREIGN PATENT DOCUMENTS

CN 109395320 A 3/2019

OTHER PUBLICATIONS

English abstract of CN109395320A.
International Search Report for related PCT Application No. PCT/US2022/032444 dated Sep. 30, 2022.

*Primary Examiner* — Zachary T Moore
(74) *Attorney, Agent, or Firm* — Caesar Rivise, PC

(57) ABSTRACT

An exercise device includes an elongate guide having a longitudinal dimension between spaced apart ends. A pair of foot supports are slidably mounted on, and relative to the elongate guide. A body engaging member is adjacent a side edge of the elongate guide and is engageable by an individual using the device. A linkage system is connected to the pair of foot supports and to the body engaging member through rotatable connections, with the rotatable connections permitting interconnected movement of the body engaging member and foot supports in the same longitudinal direction along the longitudinal dimension of the elongate guide. Preferably, an adjustable rail also is provided by a pair of rotatably mounted arms.

21 Claims, 38 Drawing Sheets

(56) References Cited

U.S. PATENT DOCUMENTS

| | | | | |
|---|---|---|---|---|
| 10,343,014 | B2 | 7/2019 | Goldberg | |
| 10,850,159 | B2 * | 12/2020 | Goldberg | A63B 26/003 |
| 2006/0189454 | A1 | 8/2006 | Bull | |
| 2009/0298655 | A1 * | 12/2009 | Lacher | A63B 22/203 482/134 |
| 2013/0102442 | A1 | 4/2013 | Liang | |
| 2016/0317863 | A1 * | 11/2016 | Goldberg | A63B 22/14 |
| 2020/0206558 | A1 | 7/2020 | Lefkovitz | |

* cited by examiner

EXERCISE DEVICES

CROSS-REFERENCE TO RELATED APPLICATIONS

This bypass continuation-in-part application takes the benefit under 35 U.S.C. § 120 of PCT Application No. PCT/US2022/032444, filed on Jun. 7, 2022, which in turn claims the benefit under 35 U.S.C. § 119(e) of Provisional Application Ser. No. 63/208,154, filed Jun. 8, 2021, all of which are entitled EXERCISE DEVICES, and all of whose entire disclosures are incorporated by reference herein.

BACKGROUND OF THE INVENTION

Field of the Invention

This invention relates generally to exercise devices and more particularly to exercise devices capable of providing exercise of the upper and lower torso of an individual in a frontal plane through sliding movement of an exerciser on the device.

Background Art

One prior art device for providing training of the lower torso of an individual in the frontal plane is made by Reebok and is referred to as the "Reebok slide." This device includes a generally planer, low friction surface with bolsters at opposed transverse ends to limit the sliding movement of a person as the person traverses the slide from side-to-side. The person desiring to exercise on this device is required to put on a pair of slippers to provide low friction engagement with the slide surface.

In use an individual shifts his/her weight and pushes off of his/her trailing leg to provide translational back and forth movement in the frontal plane. This system does not provide optimized strength and endurance training of the lower torso in a frontal plane.

Moreover, an individual using this system is not supported and needs to rely upon his/her balance to maintain in an upright position during sliding movement. This can provide a dangerous exercise for individuals that either lack balance, coordination or simply cannot maintain control of their body during such sliding movement.

In addition, the Reebok slide does not include any hand-engaging members for use in pushing/pulling a person along the low friction surface.

One of the applicant's herein, Serge Goldberg, invented improved exercise devices including both sliding foot supports and sliding body engaging members to permit an exerciser to be supported during sliding movement of the exerciser's feet in a longitudinal direction. Those exercise devices are disclosed in U.S. Pat. No. 10,343,014.

Although the exercise devices disclosed in the Goldberg '014 patent provide the intended exercise for an individual, the foot supports and body engaging members of the various disclosed devices are not connected to each other, and therefore each foot support is free to move relative to the other foot support and to the body engaging member in an uncontrolled manner. This has provided some difficulty in the use of the devices disclosed in the Goldberg '014 patent; particularly be older individuals.

In addition, the devices disclosed in the Goldberg '014 patent do not include an effective safety rail or support to aid in preventing an exerciser for falling off, or out of the exercise device while exercising, and thereby injuring himself/herself. This is a major concern for elderly exercisers that have impaired balance and/or coordination.

Therefore, applicants believe that exercise devices of the type disclosed in the Goldberg '014 patent would be improved by an interconnecting system between the foot supports and body engaging members to provide controlled movement of the foot supports relative to each other and to the body engaging members, and desirably to transmit movement of the foot supports to the body engaging member and vice versa.

In addition, and independent of providing an interconnecting system between the foot supports and body engaging members, the inventors consider it desirable to provide the exercise device with a safety rail providing some or all of the following functions: (1) permitting an individual to easily get into, or onto the exercise device when a body engaging member of the device is at either longitudinal end of the exercise device; (2) providing protection against an individual falling off of or out of the exercise device while carrying out a sliding exercise; (3) enabling an individual to grip the rail to help propel himself/herself along the exercise device while engaged in a sliding exercise with the rail in front of the individual and/or (4) enabling an individual to rail sections disposed adjacent opposite ends of the exercise device to permit the individual to push/pull himself/herself in a sliding exercise movement.

The exercise devices of the present invention include the features specified in the immediately preceding paragraph.

SUMMARY OF THE INVENTION

An exercise device of this invention includes an elongate guide having a longitudinal dimension provided between spaced apart ends of said elongate guide. A pair of foot supports are slidably mounted on and relative to the elongate guide for movement along the longitudinal dimension. A guide is included adjacent a side edge of the elongate guide for guiding sliding movement of a body engaging member in a longitudinal direction, said body engaging member being engageable by an individual using the device with said individual's feet in the foot supports and sliding along the longitudinal dimension of said elongate guide in opposite directions, whereby said body engaging member is adapted to support or stabilize the individual during the movement of the individual as said individual moves along the longitudinal dimension of said elongate guide in each of said opposite directions. An improvement in accordance with this invention comprises a linkage system rotatably connected to the pair of foot supports and to the body engaging member through rotatable connections, said rotatable connections permitting interconnected movement of said body engaging member and foot supports in the same longitudinal direction along the longitudinal dimension of the elongate guide.

In a preferred embodiment of the invention, a connector is connected to each of the foot supports for movement with each of said foot supports. The linkage system rotatably connected to the pair of foot supports and to the body engaging member includes a pair of elongate links, a first of said pair of elongate links being rotatably connected through rotatable connections at spaced apart locations thereon to the connector connected to one of said pair of foot supports and to the body engaging member, respectively, and a second of said pair of elongate links being rotatably connected through rotatable connections at spaced apart locations thereon to the connector connected to a second of said pair of foot supports and to the body engaging member, respectively, said first and said second of said pair of links being interconnected through one or more movable members to transmit rotation movement of one of said pair of elongate links to the other of said pair of elongate links about said connectors connected to the body engaging member upon relative movement between said first of said pair of foot supports and the second of said pair of foot supports or upon relative movement between the body engaging member and one of said pair of foot supports to provide interconnected movement of said body engaging member and foot supports in the same longitudinal direction along the longitudinal dimension of the elongate guide.

In one embodiment of this invention, moveable members to transmit rotation movement of one of said pair of elongate links to the other of said pair of elongate links include a pair of cooperating gears connected, respectively, to rotate with the first and second links when said first and second links rotate relative to said body engaging member, said cooperating gears including meshing gears for transmitting rotational movement of each of said first and second links to said other of said first and second links.

In an alternative, preferred embodiment of this invention moveable members to transmit rotation movement of one of said pair of elongate links to the other of said pair of elongate links include a pair of pulleys including interconnecting drive belts for transmitting rotational movement of each of said first and second links to said other of said first and second links. The pulleys are connected to rotate with the first and second links in the same manner as the cooperating gears are connected to said links.

In accordance with this invention, each of the first and second links can include an elongate slot therein, and the connector that is connected to each of the first and second foot supports is retained in a slot of a respective link and is moveable within the slot of its respective link when the respective link is being rotated as a result of relative movement between the foot supports or relative movement between one of said foot supports and said body engaging member.

In a more preferred embodiments, each of the first and second links includes a rail section instead of an elongate slot spaced from a respective meshing gear thereon, said connector connected to each of said first and second foot supports including a low friction member engageable with and movable along the rail section of its respective link when the respective link is being rotated as a result of relative movement between the foot supports or as a result of relative movement between one of said foot supports and said body engaging member.

Most preferably each of said low friction members is a bushing or bearing engaging the rail section and moveable thereon, each of said bushings or bearings including a vertically extending axle rotatably mounted to a respective foot support, whereby movement of each foot support relative to the body engaging member permits rotational movement of the bushing or bearing as it slides along the rails section.

In a preferred embodiment the rail section is an elongate rod; however, other configurations can be employed to provide the rail section; a flat member including a raised section providing a rail to be engaged by the low friction member, e.g., bushing or bearing.

In another embodiment of this invention, a moveable member to transmit rotation movement of one of the pair of elongate links to the other of said pair of elongate links includes a mounting member connected to a support frame for vertical movement on said support frame toward and away from said foot supports when said first a second links are moved relative to each other, said support frame being part of said body engaging member and being mounted for sliding movement in a longitudinal direction substantially parallel to the longitudinal dimension of said elongate guide.

In the preferred embodiments of this invention, a mount for the elongate guide permits reciprocating or rocking movement of the elongate guide for alternately permitting each of the spaced-apart ends thereof to move upwardly and downwardly relative to a longitudinal support surface for the exercise device.

In one embodiment of this invention the body engaging member includes a seating piece to support an individual in a seated position while the individual is exercising.

In a further embodiment of this invention the body engaging member includes a back engaging member for engaging the back of an individual when said individual is sliding on the exercise device in a standing position.

In preferred embodiments of this invention, the exercise device includes a rotatably mounted, arm segment adjacent each spaced apart end of the elongate guide, each arm segment being rotatable in a horizontal plane about a vertical axis between closed and open positions, said arm segments when in a closed position being in axial alignment, a connecting system is configured to connect the arm segments together when in a closed position to prevent inadvertent movement of the arm segments into an open position, said arm segments when in a closed position being generally parallel to the longitudinal dimension of the elongate guide for overlying the body engaging member as said body engaging member is moving in a longitudinal direction between spaced-apart ends of said elongate guide to provide a continuous safety rail for an exerciser when in a closed position and also a rail to be manually engaged by an exerciser to assist in propelling the exerciser along the elongate guide.

Most preferably, each of the elongate arm segments can be moved into positions substantially 90 degrees in either rotational direction from said closed position wherein each of said elongate arm segments is a side rail.

In preferred embodiments of this invention, each of said rotatably mounted elongate arm segments, in addition to being rotatable in a horizontal plane, also is rotatable in a vertical plane about a horizontal axis substantially parallel to the direction of elongation of said respective elongate arm segments to thereby position said arm segments closer or farther from the body engaging member, as desired.

In the most preferred embodiments, locking means are provided to retain each of the elongate arm segments in desired vertical and horizontal rotational positions.

BRIEF DESCRIPTION OF THE DRAWINGS

The invention will be described in conjunction with the following drawings wherein like reference numerals designate like elements therein.

DETAILED DESCRIPTION OF THE INVENTION

Figure 1:
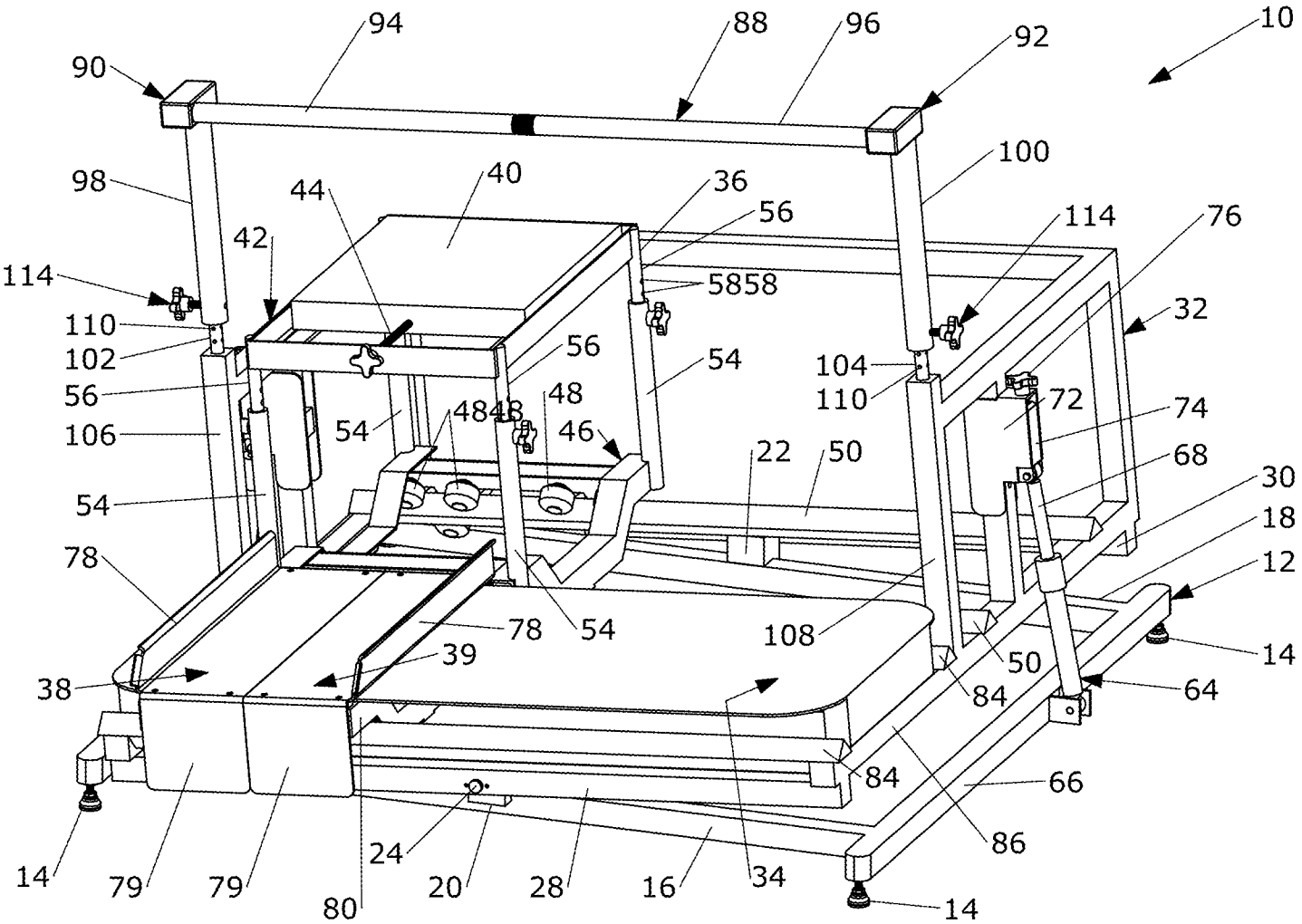
FIG. 1 is a perspective view of an exercise device in accordance with this invention.
Figure 2:
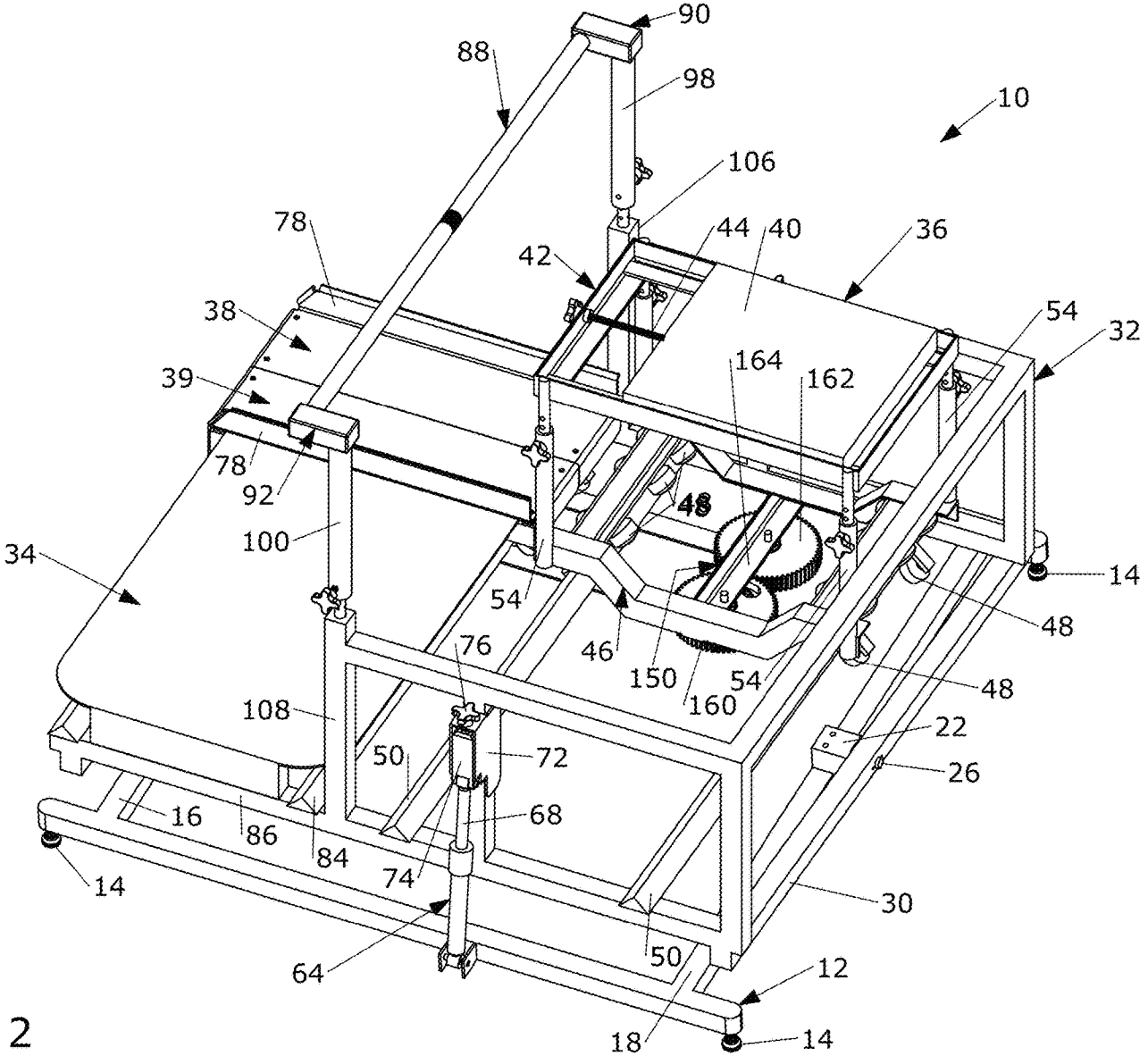
FIG. 2 is a perspective view of the exercise device shown in FIG. 1; viewed from the top thereof.

Referring to FIGS. 1 and 2, an exercise device in accordance with one embodiment of this invention is shown at 10. The exercise device 10 includes a base member 12 engaging a floor or other support surface through base member levelling feet 14. The base member 12 includes front and rear frame members 16, 18 that include mounts 20, 22 extending up from the front and rear frame members thereof. The mounts 20, 22 include axles 24, 26, respectively, extending outwardly therefrom. The axles 24, 26 are received within bushings or bearings in the front and rear frame members 28, 30 of a mounting member 32 to permit reciprocating movement of mounting member 32 relative to base member 12.

Referring to FIGS. 1, 2, 10 and 11, the mounting member 32 supports elongate guide 34 including a platform, and a body engaging member 36 behind the platform. Foot supports 38 and 39 are slidably mounted on elongate guide 34 by a mounting arrangement to be described hereinafter. The body engaging member 36 includes a seat 40 mounted for horizontal adjustment on upper frame section 42 by an adjustment screw 44.

Referring to FIGS. 1, 2 and 10 through 13, a lower frame section or carriage 46 of the body engaging member 36 includes a plurality of supporting rollers 48 rotatably mounted thereon. Not all of the rollers are numbered for purposes of clarity. The rollers 48 are rotatably mounted on spaced-apart guide rails 50 that are included on a lower section of the mounting member 32. The guide rails 50 extend in a longitudinal direction to permit sliding movement of the body engaging member 36 along the longitudinal direction between longitudinally spaced ends of said guide rails 50.

Still referring to FIGS. 1, 2 and 10 through 13, the lower frame section 46 of the body engaging member 36 includes upstanding hollow members 54 at corners thereof for telescopically receiving downwardly extending posts 56 forming part of the upper frame section 42. A plurality of vertically spaced passages 58 (FIGS. 12 and 13) are included in posts 56. A locking member 60 including a stem 62 extends through a passage in each of the hollow members 54 to engage within a desired, aligned passage 58 in each of the posts 56 to permit vertical adjustment of the upper frame section 42 including seat 40 thereon relative to lower frame section 46 of the body engaging member 36. This type of adjustment is desired to accommodate users of varying height.

Figure 42:
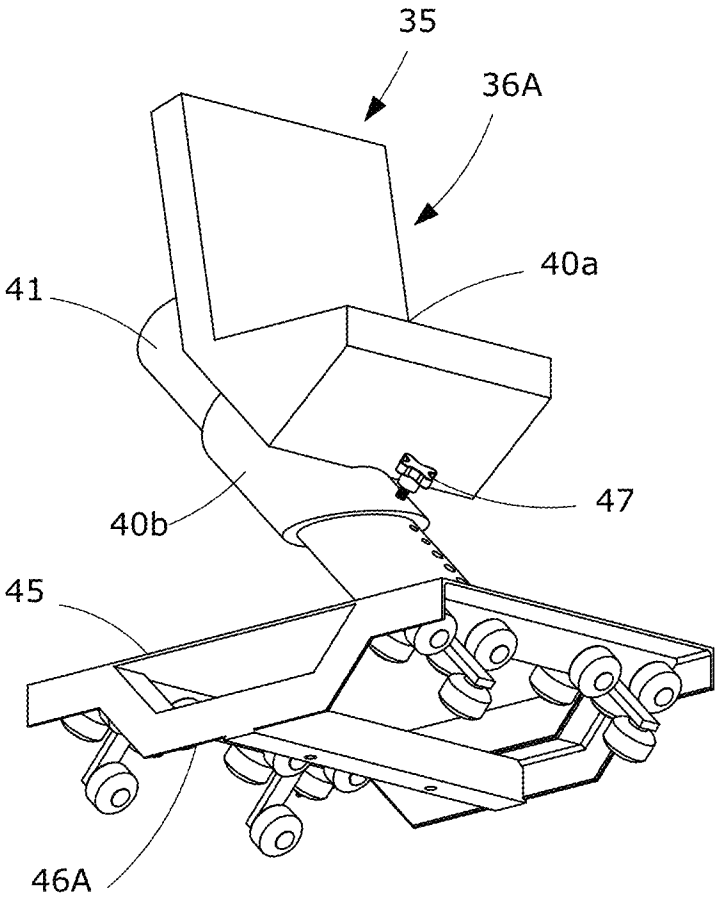
FIGS. 41 and 42 show different perspective views of an alternate system for mounting a body support member, preferably including a chair, for both vertical and horizontal adjustment.
Figure 41:
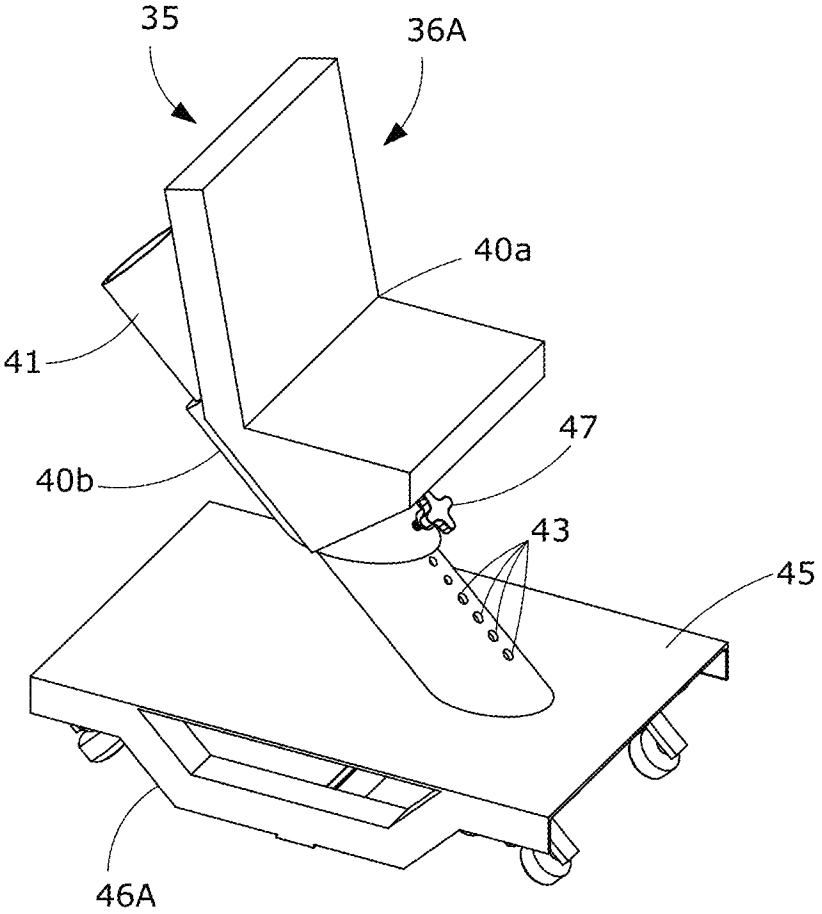

Referring to FIGS. 41 and 42, an alternate arrangement for vertically and horizontally adjusting a body engaging member 36A including seat 40*a* is shown at 35. In this embodiment, the seat 40*a* is secured by any suitable means (e.g., welding, bolting, etc.) to a tubular connector or guide 40*b*, and this tubular connector telescopes over a rail 41, in the form of a tube including vertically spaced openings 43 therein to permit adjustment of the body engaging member 36A. The rail 41 is secured to a horizontal platform 45 at an angle; preferably at a 45-degree angle thereto, and the horizontal platform is secured to lower frame section 46A, which preferably is the same as frame section 46 (FIG. 1) and provides the same function as frame section 46. The tubular connector 40*b* includes a passage (not shown) through a lower section thereof, and a locking knob 47 extends through the passage and a desired opening 43 in the rail 41 to set the body engaging member 36A in a desire position relative to the foot supports 38, 39 of the exercise device.

In operation of the adjusting arrangement 35, when the body engaging member 36A is moved upwardly it also moves rearwardly relative to the foot supports 38 and 39, due to the 45-degree inclination of rail 41. Alternatively, when the body engaging member is moved downwardly, it also moves forwardly relative to the foot supports 38 and 39. Thus, although simpler in operation than the adjustment system for the seat 40 in the FIG. 1 embodiment, the vertical and horizontal adjustments cannot be made separately, as it can be in the FIG. 1 embodiment. However, by setting the rail 41 at a 45-degree angle to the horizontal platform 45, setting the proper height of the chair relative to the foot supports usually provides adequate horizontal positioning of the seat 40*a* relative to such foot supports.

Referring to FIGS. 1, 2, 10 and 11, a pair of pneumatic cylinders 64 each include a lower housing rotatably mounted to respective side frames 66 of the base member 12, and a movable piston rod 68 in said housing. Each piston rod 68 is connected at its upper end to a clevis 72 or other attachment member mounted for vertical movement within a holder 74 by an adjustment screw 76 actuated by a knob at the top thereof and extending into the clevis 72. By adjusting the vertical position of the clevis 72, the degree of reciprocating movement of the mounting member 32 relative to the base member 12 can be changed. In a representative embodiment of this invention the mounting member 32, and the elongate guide member, e.g., platform 34, thereon, can be adjusted for a desired degree of reciprocating movement.

It is within the scope of this invention to mount member 32 and guide member 34 in a manner to prevent their reciprocation; preferably maintaining the mounting member and guide member in a generally horizontal plane during use of the exercise device 10.

Referring to FIGS. 1 and 2, the foot supports 38 and 39 include side panels 78. As explained in greater detail hereinafter, during various stages of a sliding exercise on the exercise device 10 a foot on one of the foot supports is employed to transmit a force to that foot support in one longitudinal direction by engaging the side panel 78 thereof, and a foot on the other of said foot supports 38 is employed to transmit a force to that other foot support in the opposite longitudinal direction by engaging the side panel 78 of that foot support.

As shown in FIGS. 1, 7, 10 and 11, each foot support 38, 39 preferably includes a downwardly directed front panel 79 and a downwardly directed rear panel 81. A lower bracket or carrier 80 is attached to the front and rear panels 79, 81 of each foot support 38, 39 by a weldment or any other suitable attachment means. The lower bracket 80 extends under the platform 34 and rollers 82 are rotatably attached to the lower brackets 80 and rotatably engage spaced-apart, longitudinally extending rails 84 that are connected to longitudinally spaced apart frame members 86 of the mounting member 32.

Figure 7:
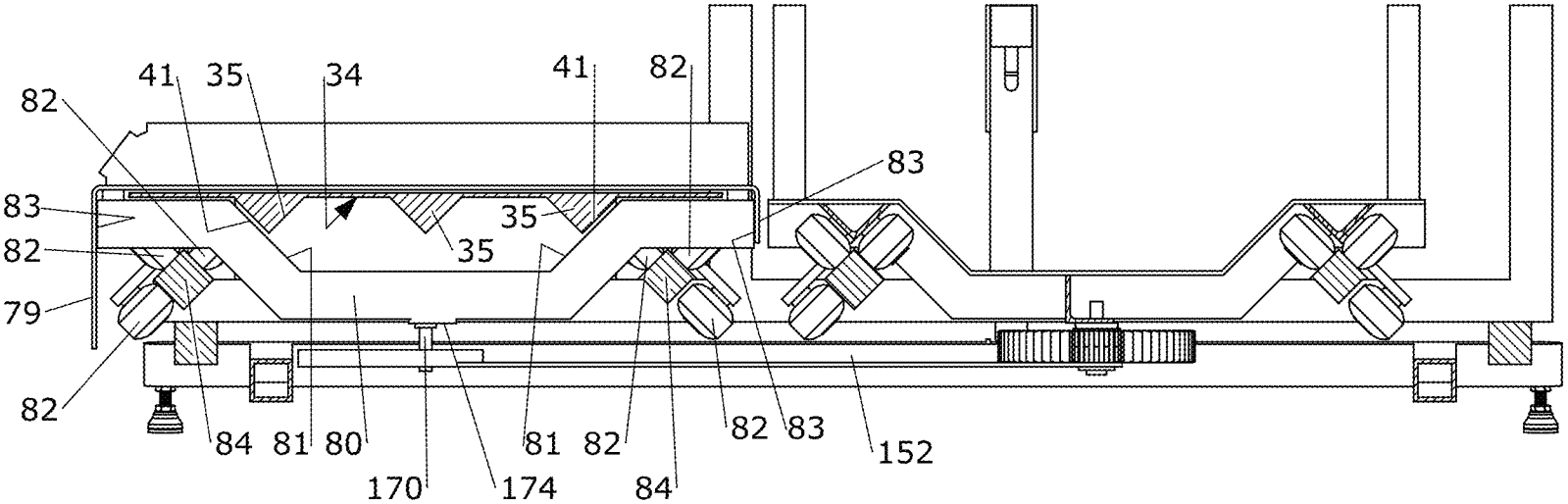
FIG. 7 is a sectional view taken along line 7-7 of FIG. 5.
Figure 8:
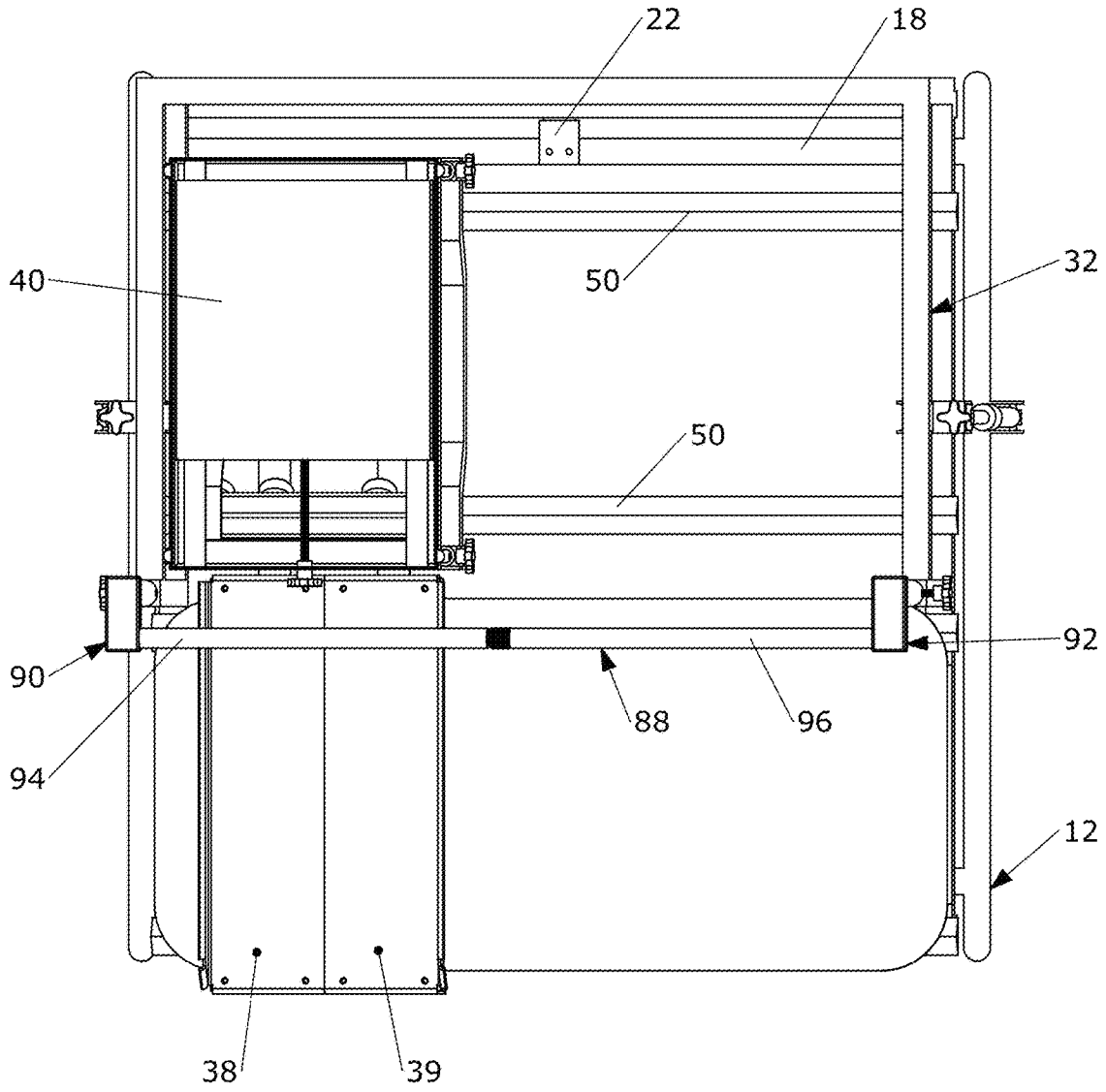
FIG. 8 is a plan view of the exercise device of FIG. 1.
Figure 11:
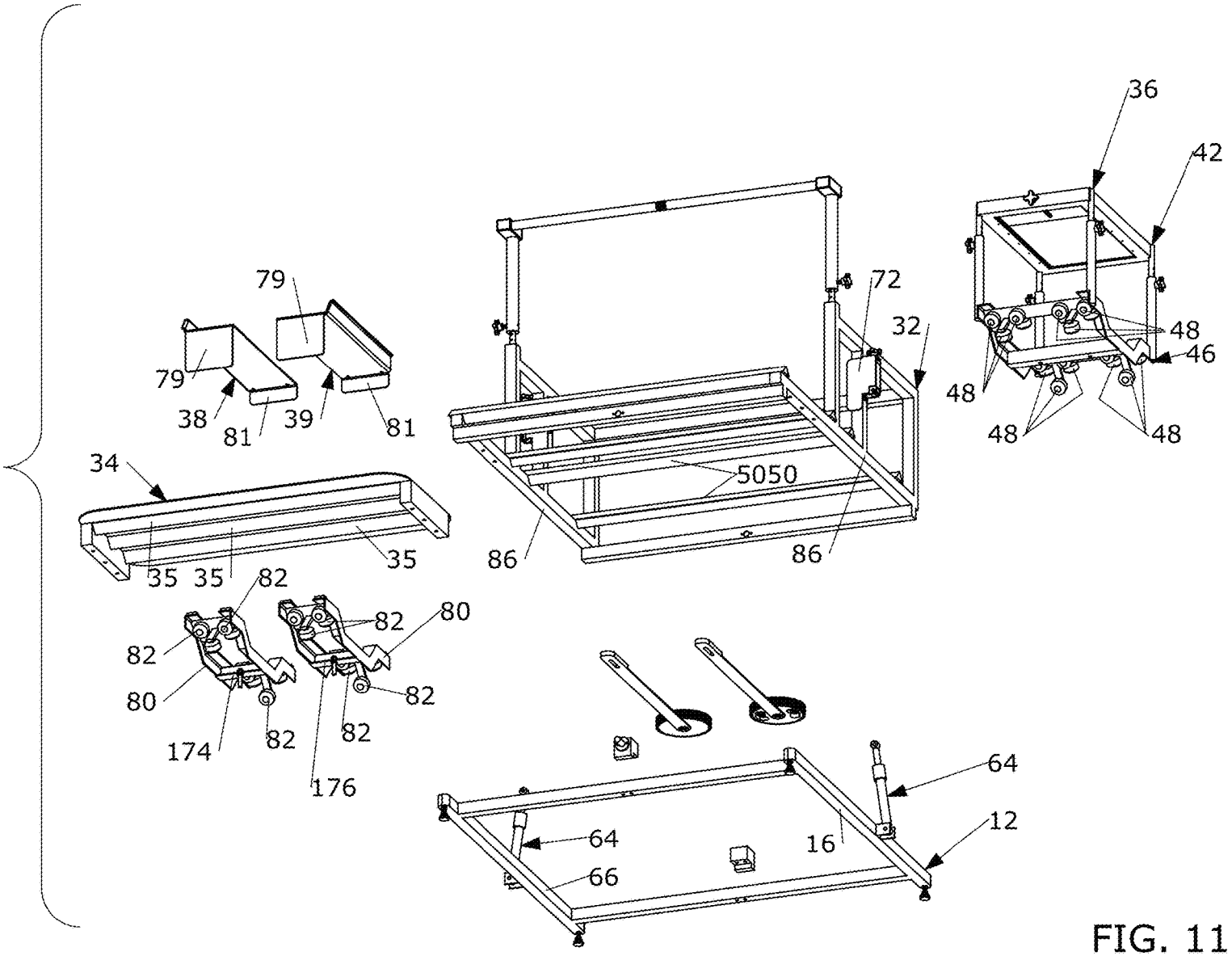
FIG. 11 is an exploded bottom right perspective view of various elements of the exercise device shown in FIG. 1.
Figure 13:
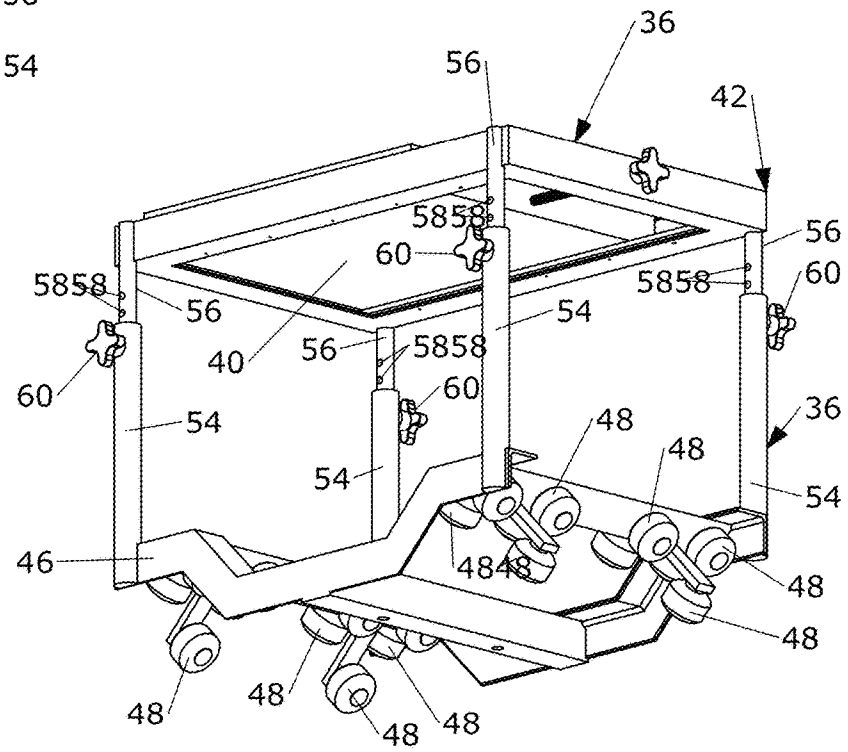
FIG. 13 is a bottom perspective view of the body engaging member in the embodiment of the invention shown in FIG. 1, in the form of a seating piece.
Figure 12:
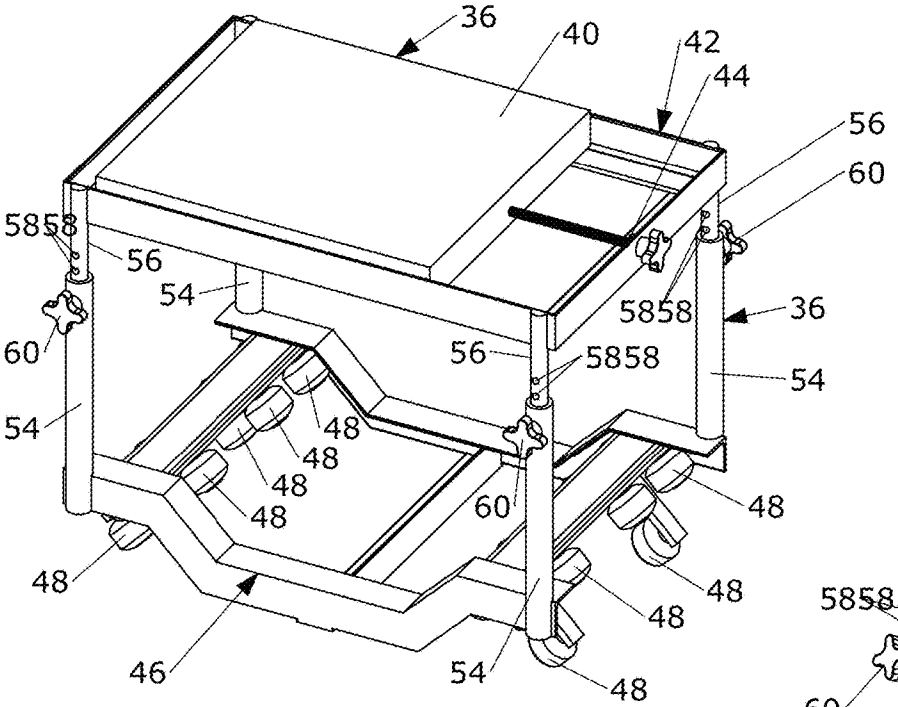
FIG. 12 is a top perspective view of the body engaging member in the embodiment of the invention shown in FIG. 1, in the form of a seating piece.
Figure 14:
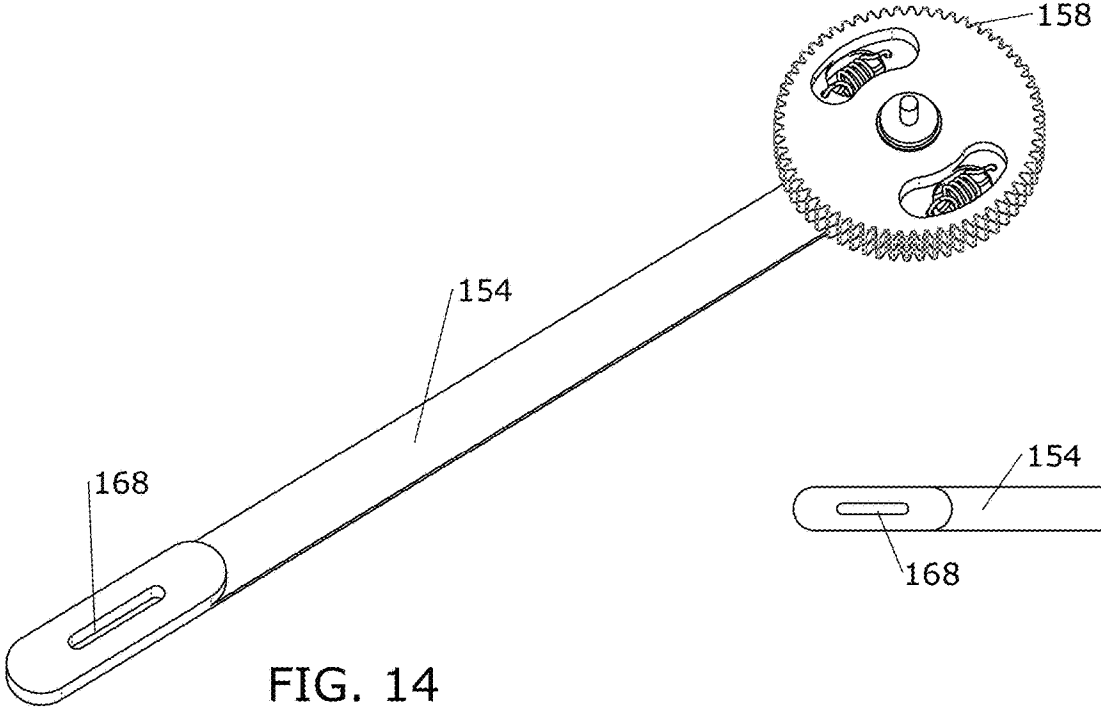
FIGS. 14-17, show various views of one of the links interconnecting the body engaging member and a foot support of the exercise device shown in FIG. 1, and including a preferred gear construction connected to the link and rotatable therewith.
Figure 15:
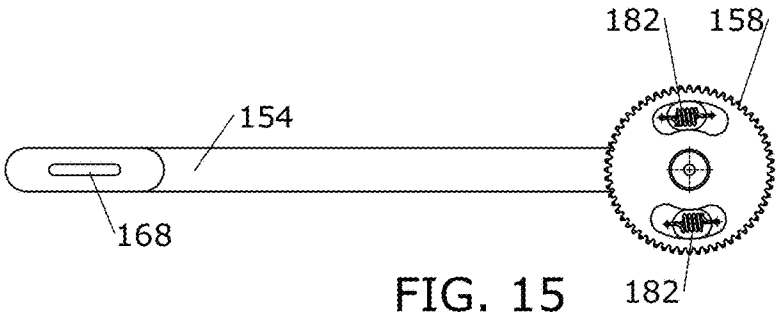
Figure 16:
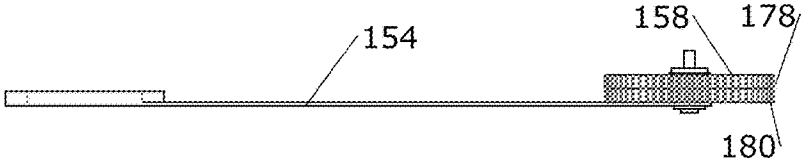
Figure 17:
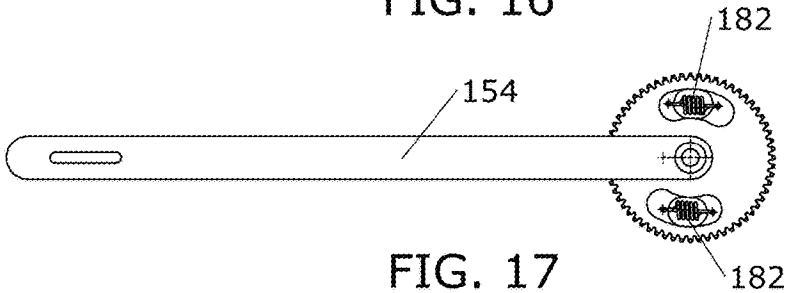

As can be seen best in FIGS. 7 and 11, the platform 34 includes elongate, downwardly directed extensions 35; three being shown herein. The two outer projections include out surfaces 41 contiguous and closely spaced to inner, inclined surfaces 81 of lower bracket 80 to provide stability for the lower bracket 80 as it moves along longitudinal rails 84 (FIG. 7).

Referring to FIGS. 1 and 2, the exercise device 10 includes a unique rail 88. Specifically, the rail 88 includes arms 90, 92 adjacent respective longitudinal ends of mounting member 32. The arms 90, 92 are of identical constructions, having substantially longitudinally extending arm segments 94, 96 and downwardly extending tubular segments 98, 100 telescopically received on posts 102, 104 extending upwardly from the top of upstanding vertical members 106, 108 of the mounting member 32.

Two rows of vertically spaced-apart passages 110 are included in each of the upstanding posts 102, 104, each row being spaced 90 degrees from the other row (only passages in one row being shown at 110). A passage 112 is included adjacent a lower end of each tubular segment 98, 100.

Figure 5:
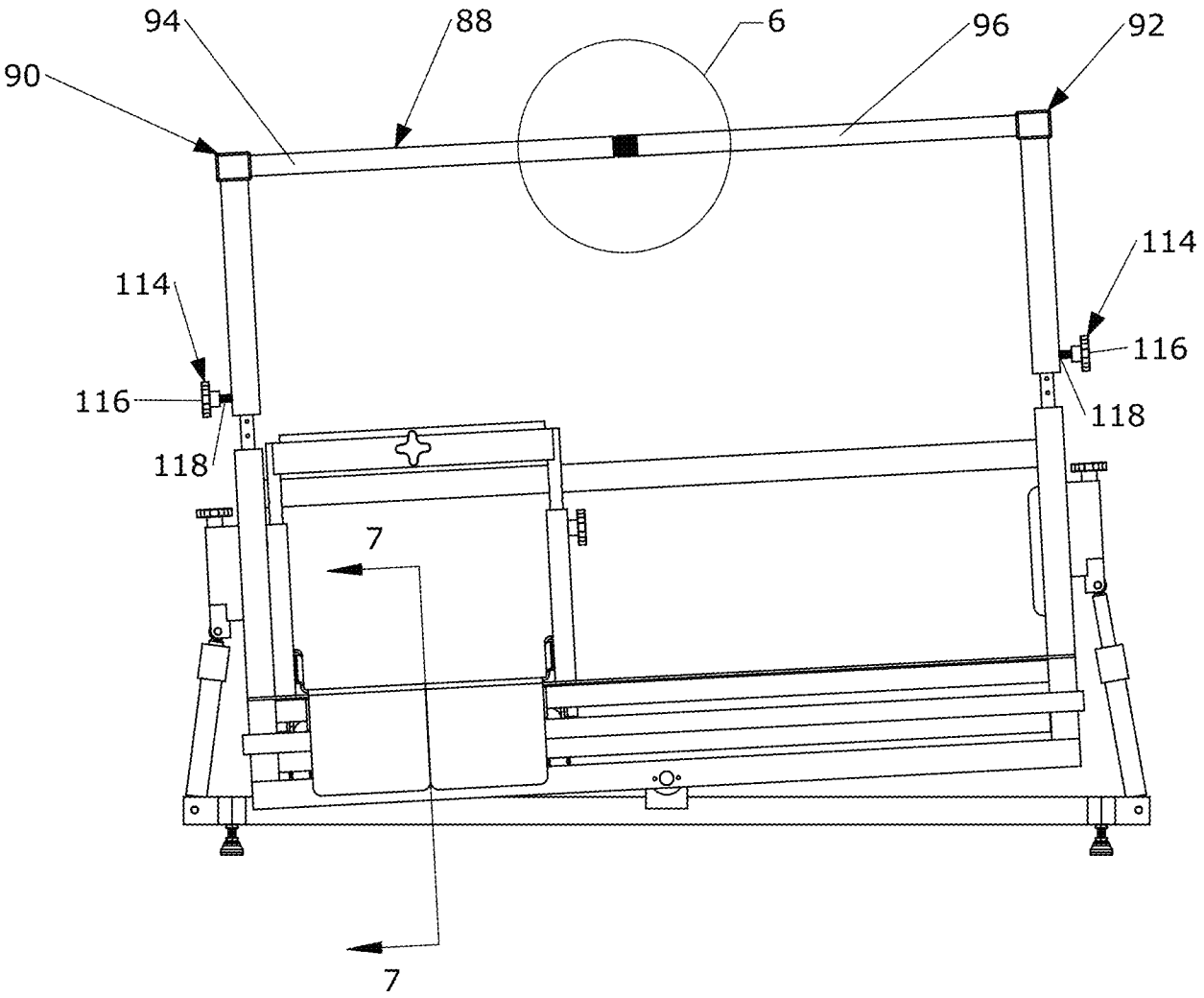
FIG. 5 is a front elevational view of the exercise device of FIG. 1.

Referring to FIG. 5, a locking and positioning members 114 is included in each of the tubular segments 98, 100. Each locking and positioning member 114 includes a knob 116 and a threaded stem 118 attached to the knob 116. The stems extend through passages 112 in respective tubular segments 98, 100, and into a desire passage 110 in one of said rows of passages in upstanding posts 102, 104 to maintain or lock the arm 90, 92 at a desired height, and also in a desired open or closed position, respectively.

Figure 3:
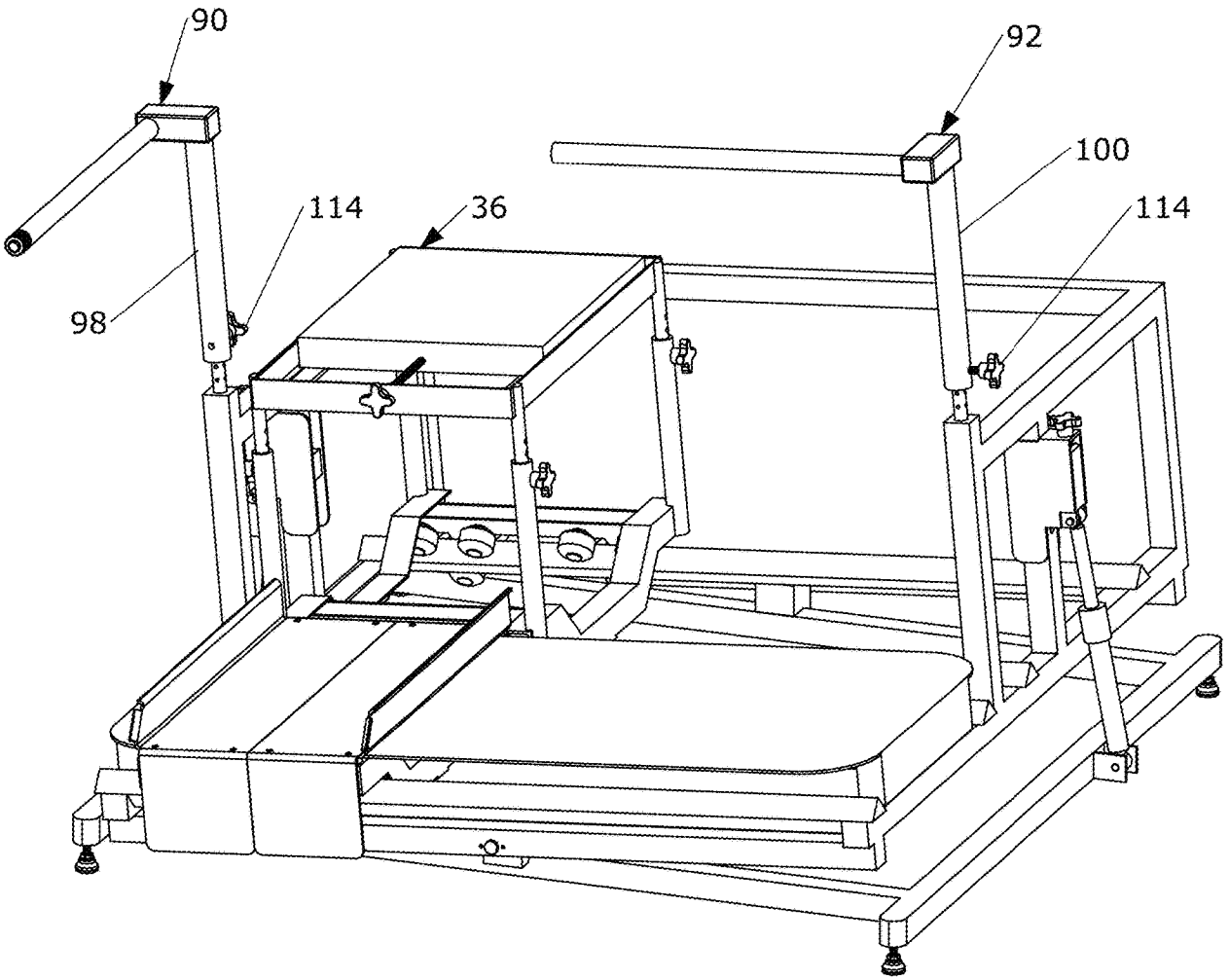
FIG. 3 is a perspective view similar to FIG. 1, but showing one of the rails in an open condition to permit access to the device.

Referring to FIG. 3, arm 90 is shown in an open position to permit an individual to enter the exercise device 10 when the body engaging member 36 is aligned with the opening. The arm 90 is locked in its open position by the locking and positioning member 114 associated therewith and extending into an opening 110 in one of the rows in upstanding post 102. An individual entering the device can support himself/herself by holding onto the open arm segment 94. As can be seen in FIG. 3, the other arm segment 96 is maintained in a locked, closed position, extending along the longitudinal extend of the exercise device 10.

Figure 4:
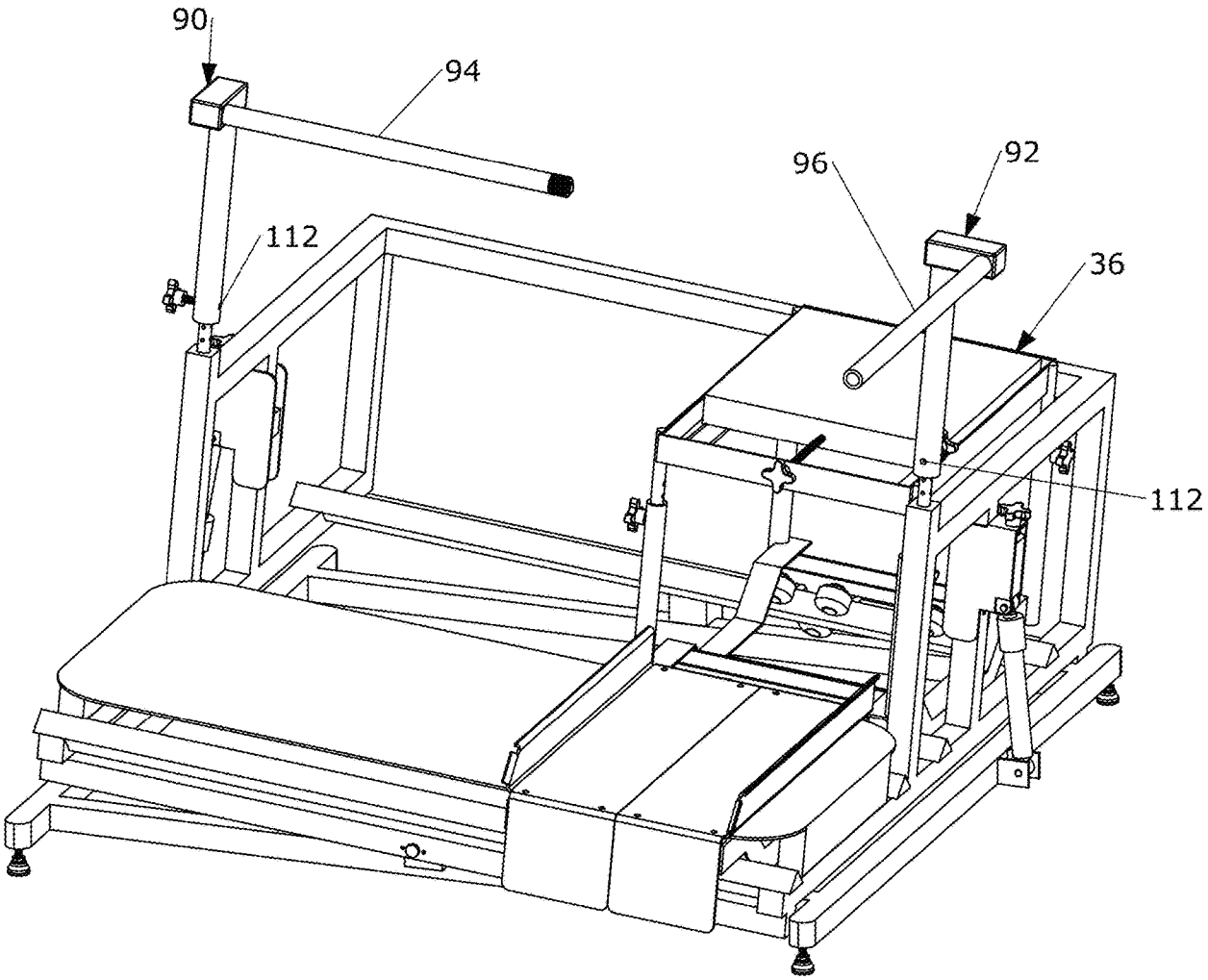
FIG. 4 is a perspective view of the exercise device similar to FIG. 3, but with the foot supports and body engaging member at the opposite longitudinal end from that shown in FIG. 3, and with the other rail in an open condition to permit access to the device.

Referring to FIG. 4, the arm 92 is shown in an open, locked position to permit an individual to enter the exercise device 10 when the body engaging member 36 is aligned therewith, and the arm 90 is maintained in a closed position, extending along the longitudinal extend of the exercise device 10.

Referring to FIG. 5, the arm segments 94, 96 are shown in a locked condition to form a continuous rail 88. The rail 88 aids in preventing an individual from falling out of the exercise device 10, and also permits the individual to grasp the rail to assist in propelling himself/herself in a sliding movement along the exercise device 10 in opposed directions.

Figure 6A:
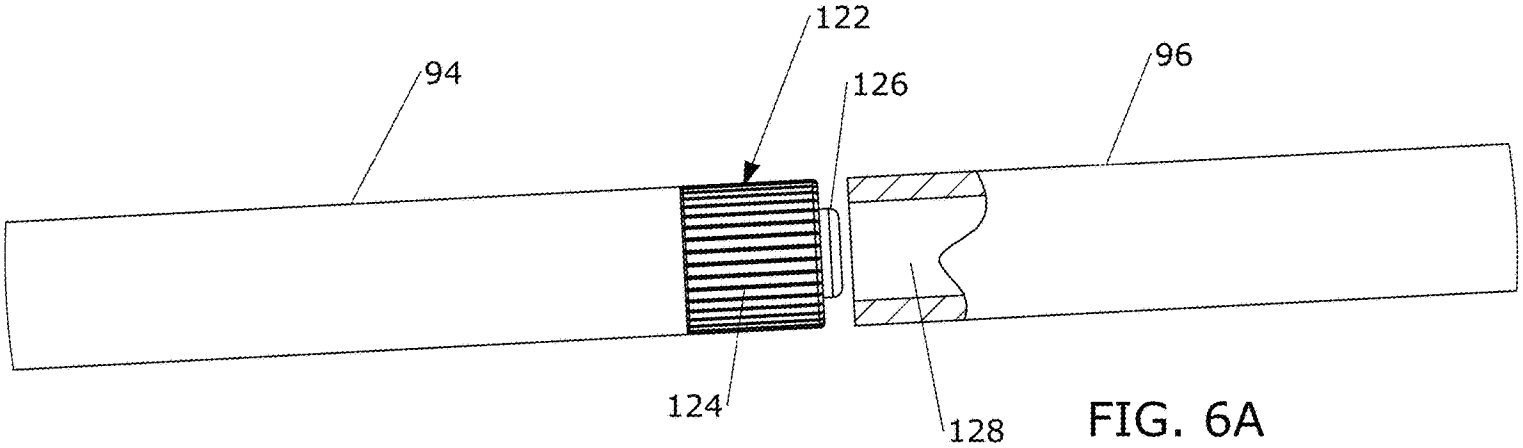
FIGS. 6A and 6B are enlarged views of the circled area in FIG. 5 showing the sections of the rail in an unlocked and locked condition, respectively.
Figure 6B:
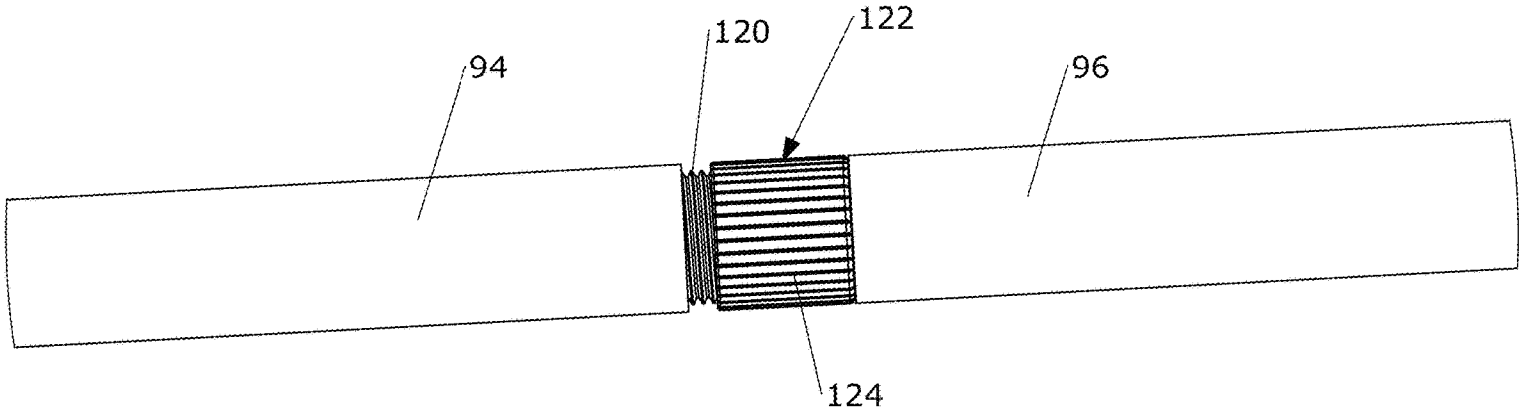

Referring to FIGS. 6A, 6B, a distal end of one arm segment 94 includes a threaded section 120. A locking member 122 including a threaded sleeve 124 cooperates with threaded section 120 and includes a locking projection 126 configured to be received within hollow passage 128 of arm segment 96. As can be seen most clearly in FIG. 6B, the locking member is substantially the same diameter as the arm segments 94 and 96, to provide a substantially continuous outer rail surface free of raised projections that would interfere with an individual grasping and sliding his/her hands along the rail while exercising. It should be noted that various locking arrangements may be usable to retain the arms 90, 92 connected to form the rail 88.

Referring to FIG. 1, the arm segments 94 and 96 can be rotated counterclockwise 90 degrees in a horizontal plane to positions in which the arm segments 94, 96 constitute rails on opposite sides of the body support member 36. In this position a person seated on seat 40 can manually engage the arm segments to aid in pushing and/or pulling himself/herself along the device to carry out the sliding exercise. However, when the arm segments 94, 96 are rotated 90 degrees as discussed above, there may not be an optimum spacing between them to permit their effective use in pushing or pulling an individual along the device, Still referring to FIG. 1, the arm segments 94 and 96 also can be rotated clockwise 90 degrees in a horizontal plane to positions in which the arm segments 94, 96 constitute rails on opposite sides of the foot supports. In this position a person standing on the foot supports 38, 39 and facing the body support member 36 can manually engage the arm segments 94, 96 to aid in pushing and/or pulling himself/herself along the device to carry out the sliding exercise in a standing position.

However, when the arm segments 94, 96 are rotated 90 degrees as discussed above, there may not be an optimum spacing between them to permit their effective use in pushing or pulling an individual along the device when in a standing position, Referring to FIGS. 34, 34A, 34B, 35 and 36, an alternate arrangement for connecting arm segments 94*a*, 96*a* to tubular segments 98*a*, 100*a* is shown in exercise device 10A. In all other respects arm segments 94*a* and 96*a* in exercise device 10A are identical to arm segments 94 and 96 in device 10 shown in FIG. 1, and tubular segments 98*a* and 100*a* are identical to tubular segments 98 and 100 in device 10 in FIG. 1. In fact, except for the unique/different attachment of the arm segments 94*a* and 96*a* to the tubular segments 98*a* and 100*a* in device 10A, all other features, including the structure for permitting vertical adjustment and horizontal rotation of the arm segments into a desired position and locking them in that desire position are the same as in device 10 shown in FIG. 1. These common features will not be discussed in detail hereinafter.

Figure 34:
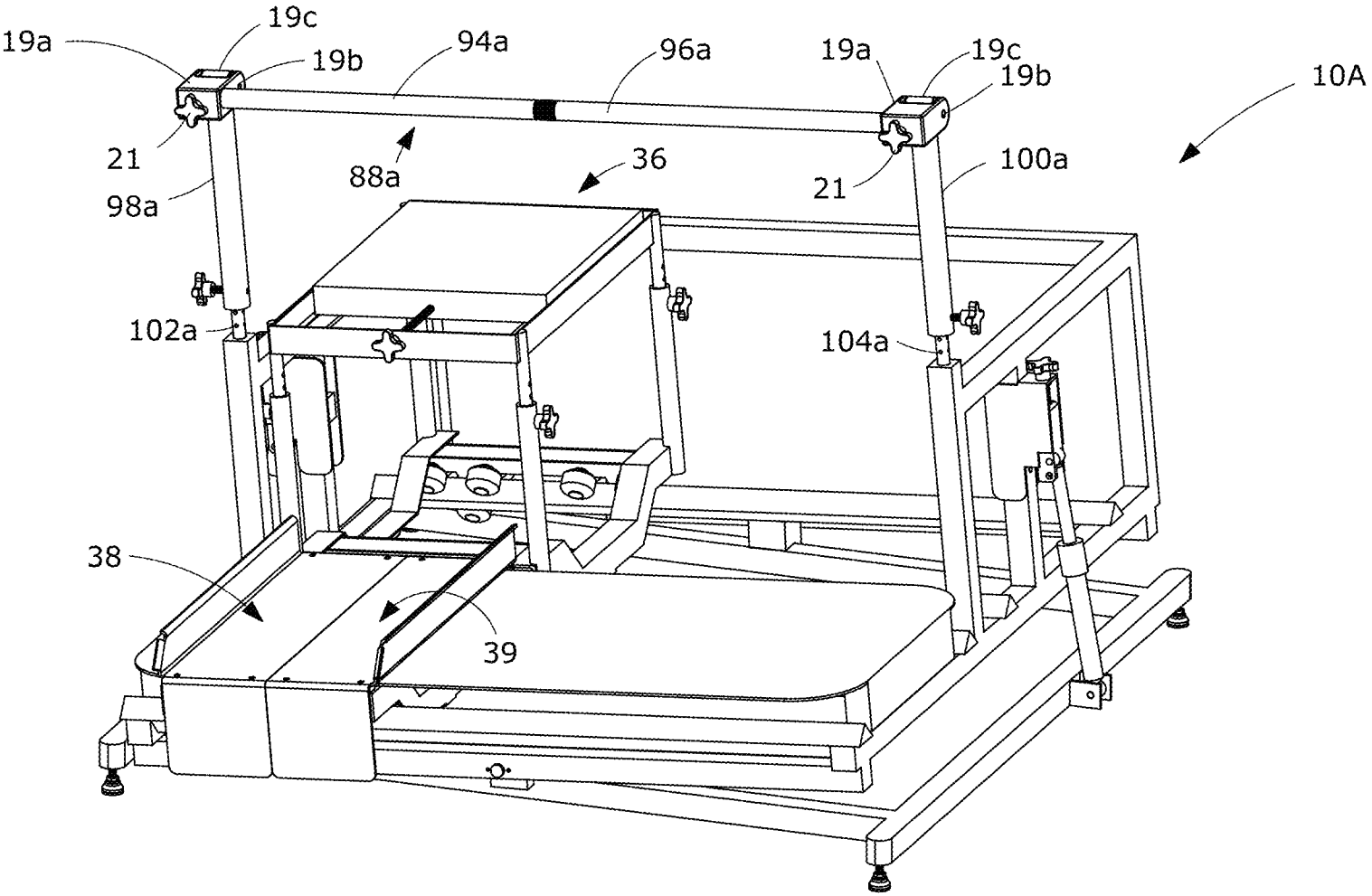
FIG. 34, is a perspective view of an exercise device including a preferred mounting for the arm segments; in all other respects the exercise device being identical to that the exercise device shown in FIG. 1.
Figure 34B:
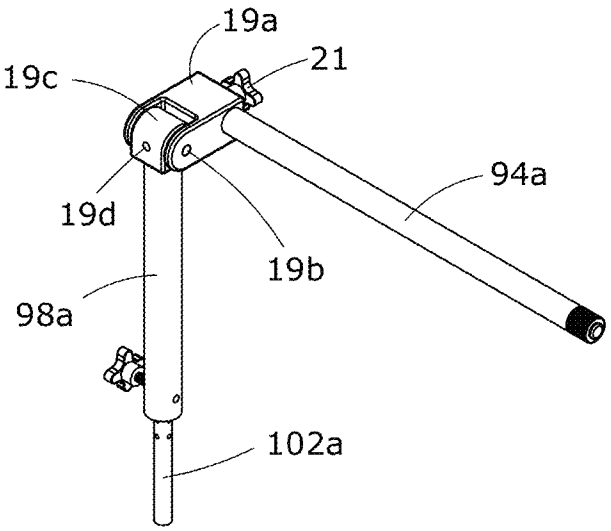
FIGS. 34A and 34B are enlarged perspective views showing the rotational mount of the arm segments and showing the arm segments in opposed rotational positions.
Figure 34A:
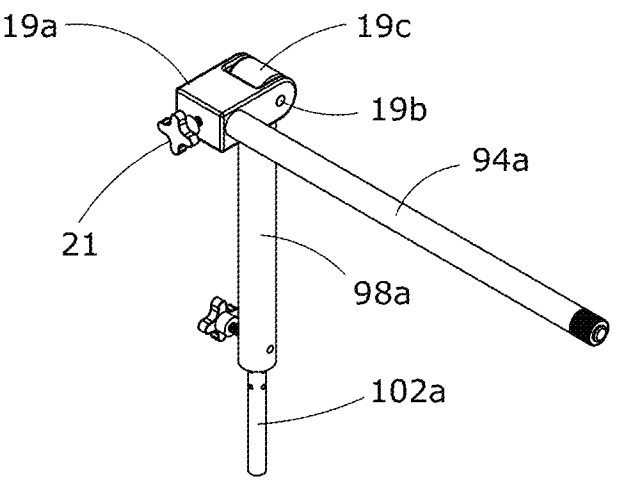

Referring to FIGS. 34, 34A and 34 B, in device 10A arm segments 94*a* and 96*a*, are each mounted for rotational movement in a vertical plane through identical connections to downwardly extending tubes 98*a*, 100*a*, which extend over posts 102*a*, 104*a*, and are vertically adjustable and rotationally adjustable in a horizontal plane, in the same manner as tubes 98 and 100 are vertically adjustable and horizontally adjustable relative to posts. 102, 104 of the device 10.

As can be seen in FIG. 34, each of the arm segments 94*a*, 96*a* is attached to a shoulder member 19*a*, which is rotatably connected by axle 19*b* to a complementary attachment member 19*c* secured to the top of the downwardly extending tubes 98*a*, 100*a*. The attachment members 19*c* each include a passage 19*d* extending therethrough for receiving the stem of a locking member 21 that passes through an upper surface of shoulder member 19*a* and into passage 19*d* when the arm segments are in a desired position.

Referring to FIGS. 34A and 34B, details of the above-described mechanism for permitting rotational movement of arm segment 94*a* in a vertical plane between two desired positions is illustrated; it being understood that the same mechanism is employed in connection with arm segment 96*a*. It also should be understood that additional passages can be provided in complementary member 19*c* to permit fixing the arm segments 94*a*, 96*a* in positions in addition to those shown in detail herein.

As can be seen in FIG. 34A, arm segment 94*a* is in a rotational position spaced outwardly of, or away from the body engaging member 36, as is shown in FIG. 34. This is a desired position for both arm segments 94*a*, 96*a*, when an individual is sitting on the body engaging member 36 and provides a continuous rail 88*a* that can be engaged by an individual to proper himself/herself back and forth during a sliding exercise. The continuous rail 88*a* is identical to continuous rail 88, except for the manner in which each arm segment 94*a*, 96*a*, is attached to the tubular members 98*a*, 100*a*. The arm segments 94*a*, 96*a* are connected together by the same locking arrangement as 122 shown in FIGS. 6A and 6B. It should be understood that any desire locking arrangement can be employed but should be one that is easy to connect and disconnect.

The position of continuous rail 88*a* shown in FIG. 34 is desirable when an individual is seated on body engaging member 36. However, in that position the continuous rail 88*a* partially overlaps the foot supports 38, 39, or is too close to such foot supports to permit an individual to employ the device in a standing position facing the body engaging member 36. However, by rotating each arm segment 94*a*, 96*a* 180 degrees from the position shown in FIG. 34A to the position shown in FIG. 34B (only arm segment 94*a* being shown in FIG. 34B; it being understood that arm segment 96*a* will be rotated into the same position as arm segment 94*a*) the continuous rail 88*a* provided by the aligned and connected arm segments 94*a* and 96*a* will be in a position to permit an individual to exercise while standing on the foot supports 38, 39 and facing the body engaging member 36. In this standing position the individual can grasp the continuous rail 88*a* to aid in propelling himself/herself in a sliding movement along the device.

Figure 35:
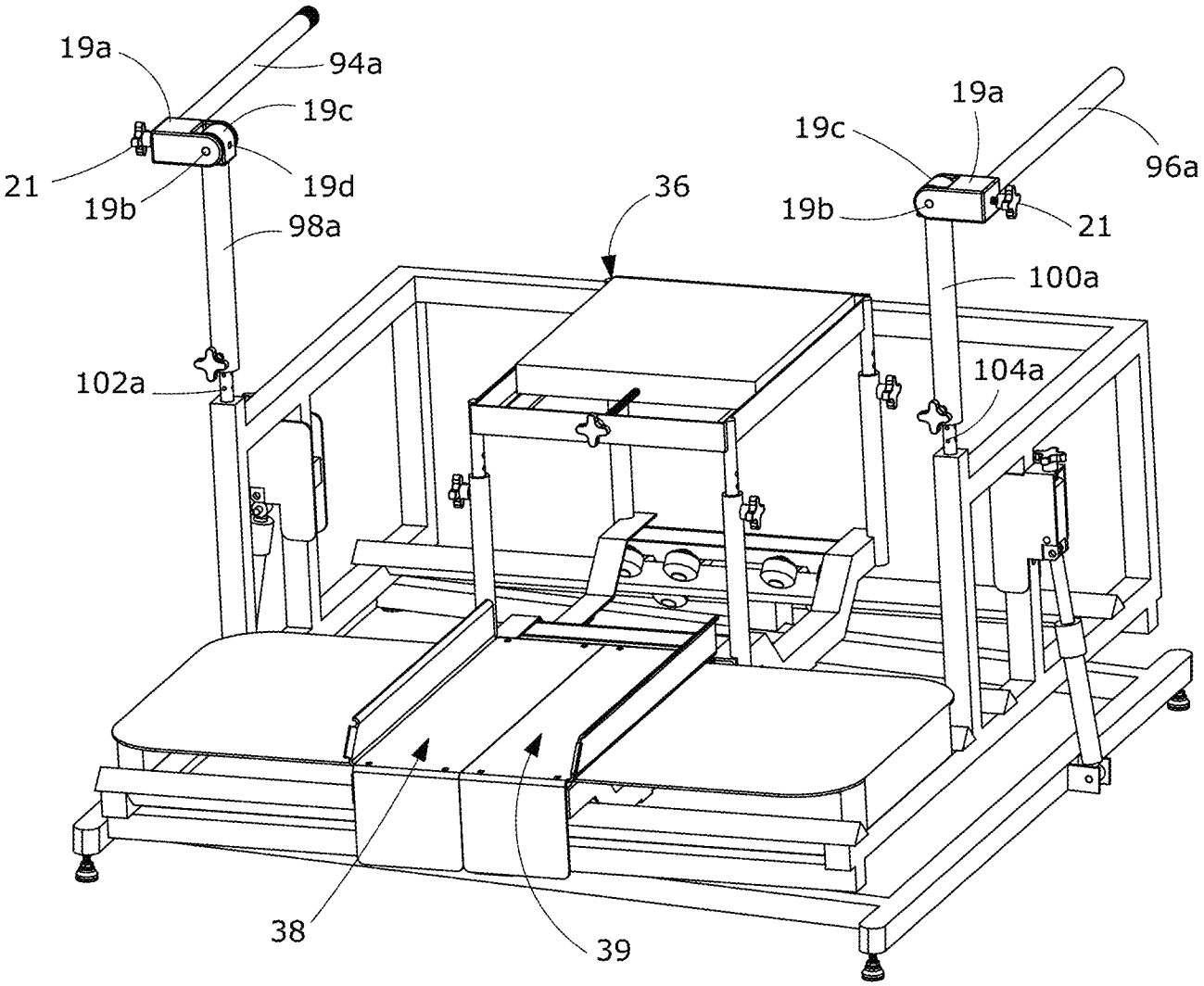
FIG. 35 shows the arm sections rotated 90 degrees in a horizontal plane in a counterclockwise direction from the position shown in FIG. 34B (only one of said arm segments being shown in FIG. 34B; the other arm segment being identically oriented) to provide side rails for engagement by an individual on the exercise device.

Referring to FIG. 35, arm segments 94*a*, 96*a* are shown rotated 90 degrees in a horizontal plane from their position providing a continuous rail 88*a* to positions wherein said arm segments are on opposite sides of the body engaging member 36. The arm sections 94*a*, 96*a* also have been rotated in a vertical plane through their connection to shoulders 19*a* to a position providing a maximum spacing between said arm segments. In this position an individual can push and/or pull himself/herself to aid in providing a sliding exercise. This permits the simultaneous exercise of both the upper and lower torso of an individual while the individual is in a seated position on the body engaging member 36.

Figure 36:
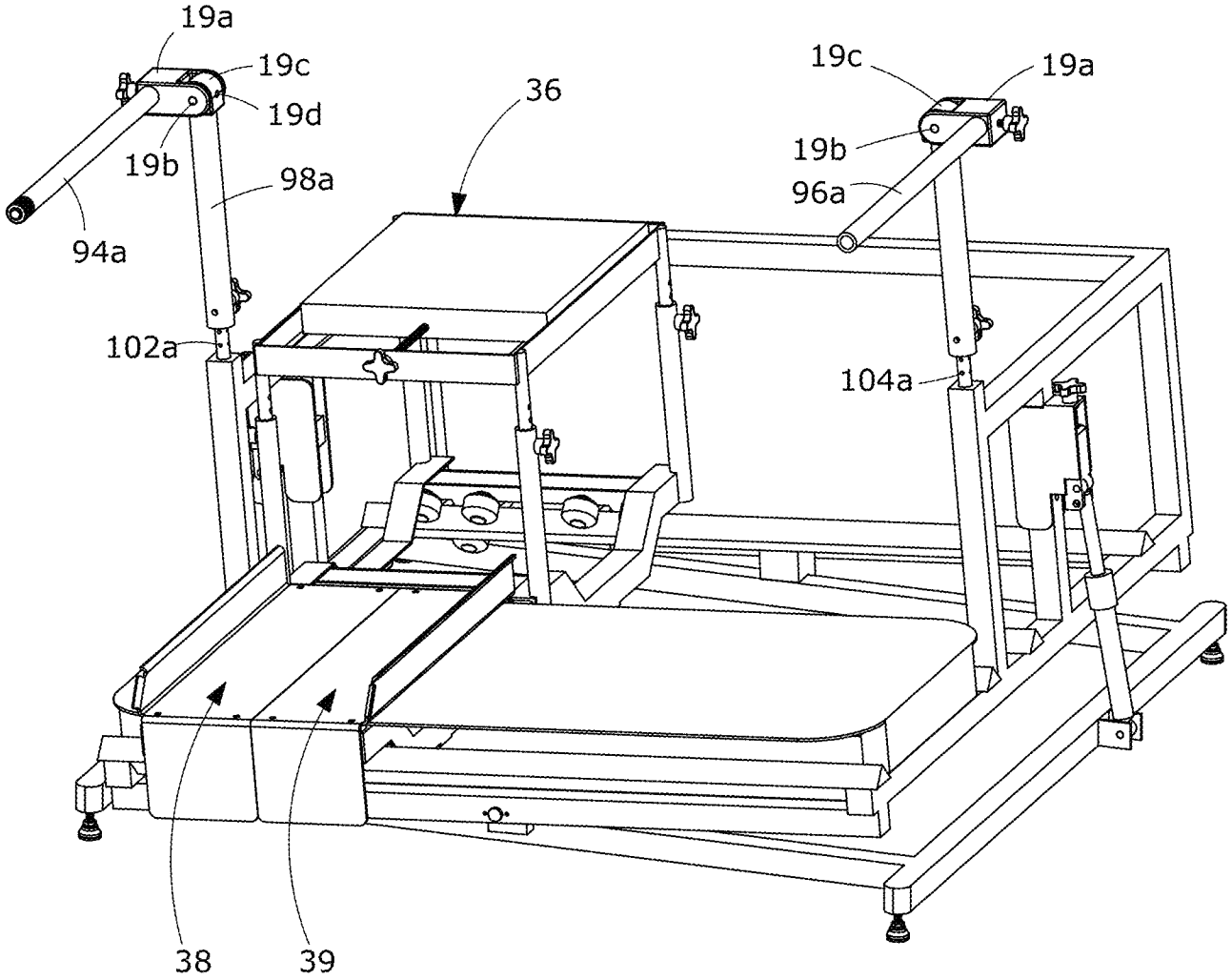
FIG. 36 shows the arm sections rotated 90 degrees in a horizontal plane in a clockwise direction from the position shown in FIG. 34A (only one of said arm segments being shown in FIG. 34A; the other arm segment being identically oriented) to provide side rails for engagement by an individual desiring to exercise by standing on the foot supports and facing the body support member.

Referring to FIG. 36, arm segments 94*a*, 96*a* are shown rotated 90 degrees in a horizontal plane from their position providing a continuous rail 88*a* to positions wherein said arm segments are on opposite sides of the foot supports 38, 39. The arm sections 94*a*, 96*a* also have been rotated in a vertical plane through their connection to shoulders 19*a* to a position providing a maximum spacing between said arm segments. In this position an individual can push and/or pull himself to aid in providing a sliding exercise while the individual is in a standing position facing the body engaging member 36. This permits the simultaneous exercise of both the upper and lower torso of an individual while the individual is in a standing position on the foot supports 38, 39.

Referring to FIGS. 2 and 9-11 a unique linkage system 150 of this invention interconnects the foot supports 38, 39 to the body engaging member 36 in a manner that prevents the foot supports from independently sliding along the elongate guide 34 in an uncontrolled manner, and also that assists in coordinating movement of the foot supports with the body engaging member during use of the exercise device 10. The operation of the linkage system 150 during use of the exercise device 10 will be described in detail later in this application. Still referring to FIGS. 2 and 9-11, the linkage system 150 includes a pair of elongate links 152, 154 rotatably connected to the foot supports 38, 39 and to the body engaging member 36. Gears 156, 158 are secured to one end of elongate links 152, 154, respectively, to rotate with the links about axles 160, 162 mounted on strut 164 forming part of lower frame section or carriage 46 of body engaging member 36.

Figure 9:
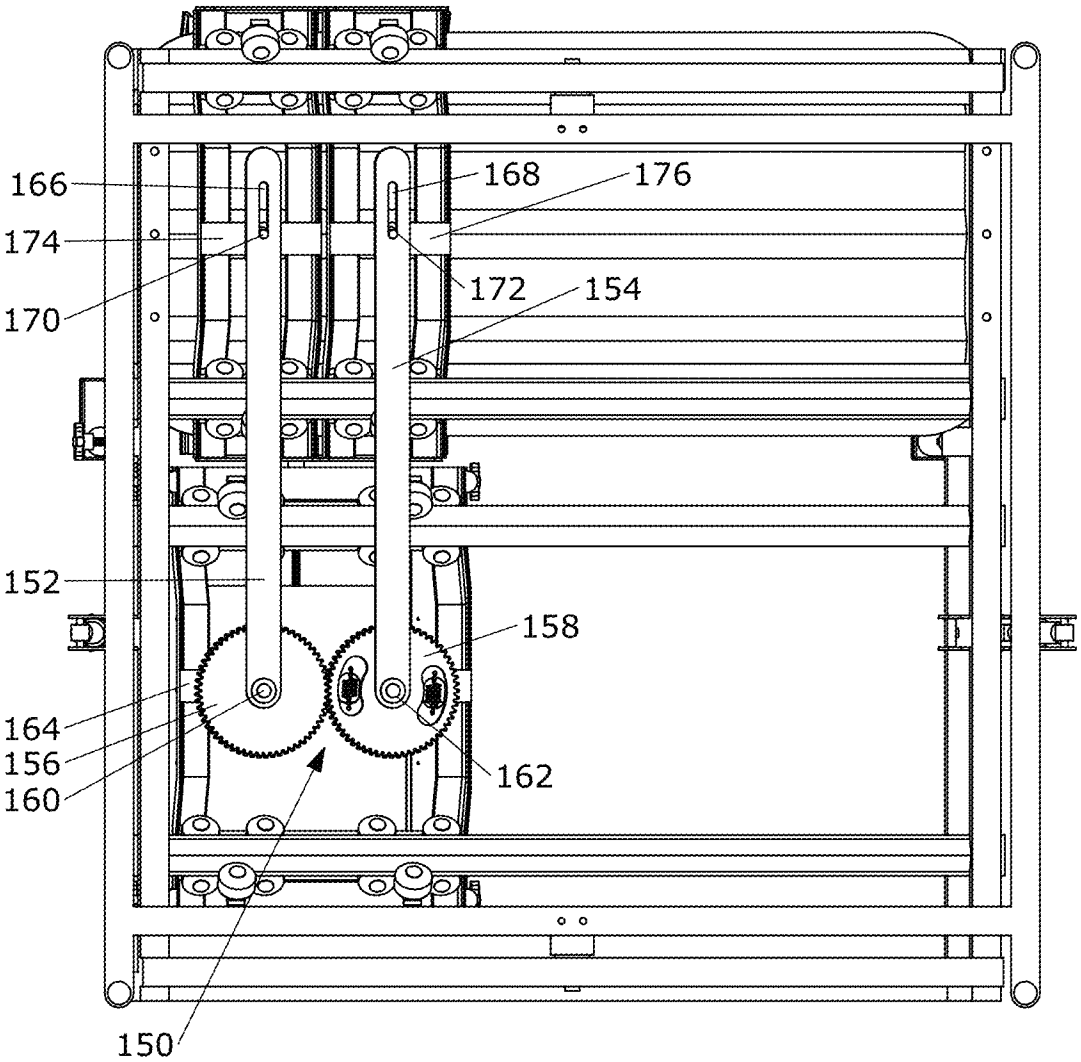
FIG. 9 is a bottom view of the exercise device of FIG. 1, showing the position of the linkage system with the foot supports and body engaging member at the end of the device shown in FIG. 1.
Figure 10:
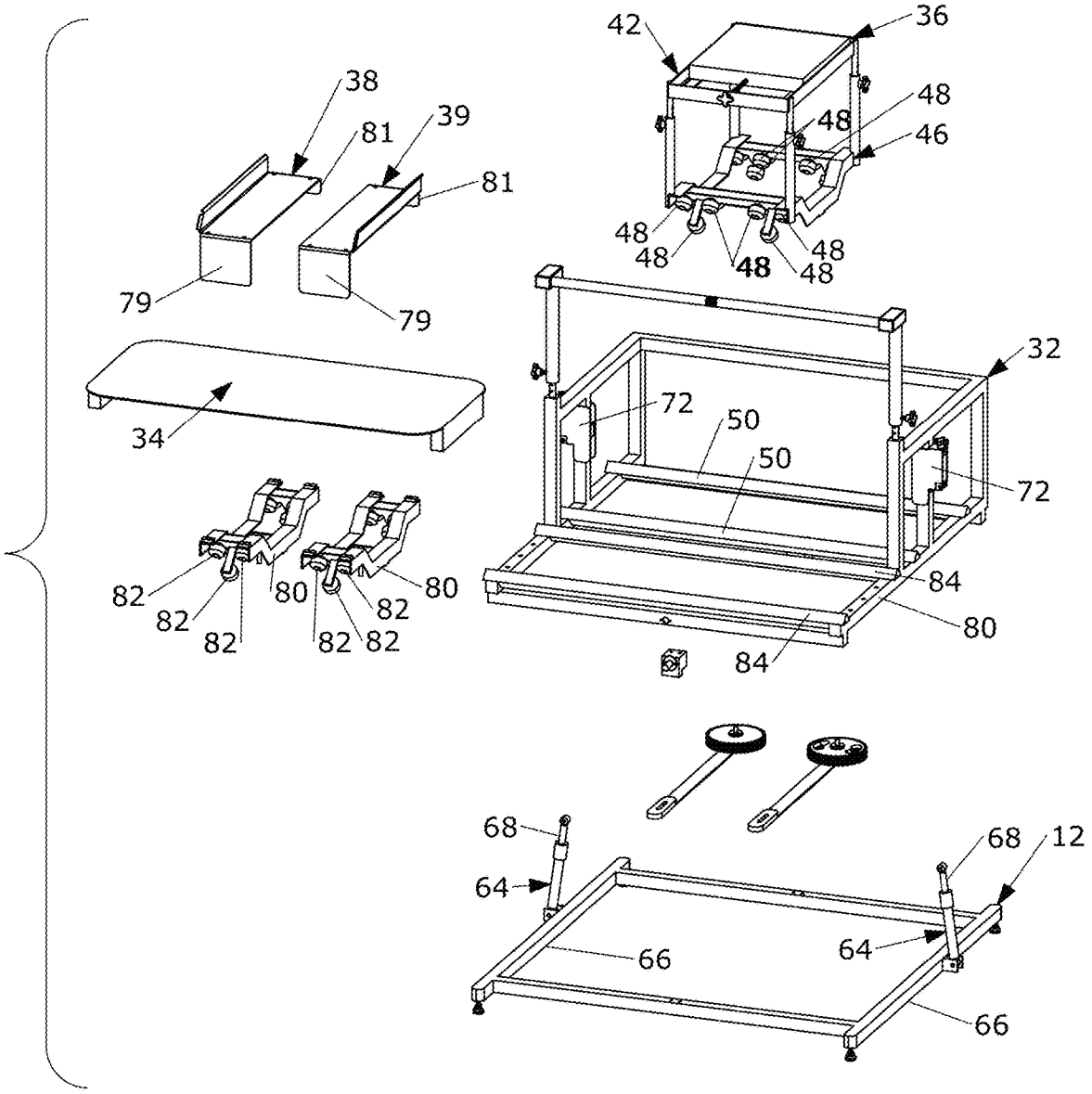
FIG. 10 is an exploded top right perspective view of various elements of the exercise device of FIG. 1.

Referring to FIGS. 7, 9 and 11, in one embodiment of the invention the links 152, 154 include elongate slots 166, 168, respectively, adjacent ends of the elongate links opposed to the ends including the gears 156, 158. Pins 170, 172 are attached to, and extend downwardly from struts 174, 176, respectively, forming a part of lower brackets 80 (FIGS. 9 and 11). The pins 170, 172 are received within the elongate slots 166, 168 in the links 152, 154 to permit relative linear movement between the links and pins when the body engaging member and links 152, 154 move at different speeds relative to each other.

Referring to FIGS. 9 and 14-18, preferably one of the gears, e.g., 158 is an anti-anti-backlash gear including disks 178, 180; each disk including teeth circumferentially offset from, but overlapping teeth of the other disk. The disks 178, 180 are interconnected by spring connectors 182 maintaining the normally offset relationship between the gear teeth in the two disks 178, 180 but permitting relative circumferential movement between said disks against a biasing force provided by the spring connectors 182. When the circumferentially offset teeth of the anti-backlash gear 158 enter a groove between adjacent teeth of the other gear 156, one of the offset teeth of anti-backlash gear 158 engages a surface of one of the adjacent teeth of the other gear 156 and the other of the offset teeth in the anti-backlash gear 158 is spring biased into engagement with the other of the adjacent teeth of the other gear 156. In this manner, the offset teeth of the anti-backlash gear 158 engage contiguous surfaces of adjacent, spaced-apart teeth in the opposed gear 156 when the offset teeth are received within the groove provided by the adjacent, spaced-apart teeth to prevent anti-backlash when rotation of the gears 156, 158 is stopped and/or reversed.

Anti-backlash gears are well-known in the art and the use of such an anti-backlash gear in this invention, as explained above, is well known to those skilled in the art.

The operation of the exercise device 10 now will be explained in greater detail. Reference to the orientation, direction of movement, and position of members will be from the location of an individual located on the body engaging member 36 of the exercise device 10 and facing outwardly therefrom toward the foot supports 38, 39, unless specifically indicated otherwise.

As a brief summary, the linkage system 150 includes two links 152, 154. Gears 156, 158 having meshing teeth are connected to the links 152, 154, respectively, and are mounted for rotation on axles 160, 162. connected to body engaging member 36. When the gears 156, 158 rotate the links 152, 154 rotate with them. The links 152, 154 in one embodiment include elongate slots 166, 168 mounted for linear movement on pins 170. 172 extending downwardly from the struts 174, 176 of the lower brackets 80 that are connected to the foot supports 38, 39 when one or both of the foot supports 38, 39 is moved relative to the body engaging member 36 and at a different speed. The body engaging member 36 and foot supports 38. 39 are mounted for movement along guide rails that are parallel to each other and that are attached to mounting member 32. As explained previously, the mounting member 32 preferably is mounted for reciprocating movement on base member 12, but in accordance with the broadest aspects of the invention the mounting member 32 can be fixed against movement to the base member 12 and retained in a generally horizontal position during a sliding exercise.

Figure 18:
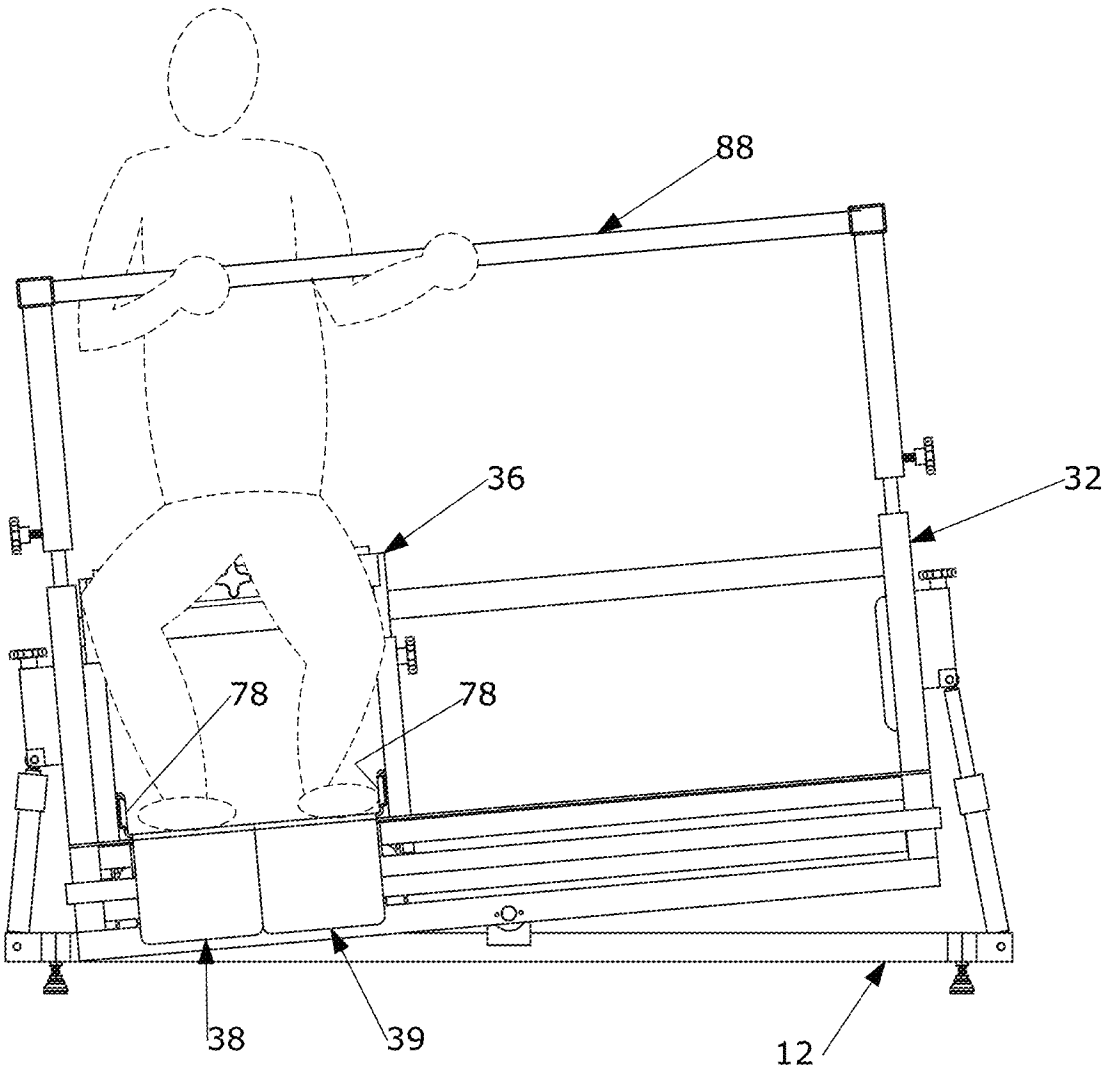
FIG. 18 is a view of the exercise device of claim 1, with parts omitted for purpose of clarity, and showing an individual supported on a seating piece and feet engaging the foot supports, with the seating piece and foot supports at one longitudinal end of the exercise device.

A representative operation of the device will now be described, with the user starting in the right position as shown in FIG. 18.

Referring to FIGS. 18, during the start of a sliding exercise, a user engages the side panel 78 of the right foot support 38 and pushes in a direction to the right. However, since the right foot support 38 is engaging the right side of the mounting member 32 it doesn't move to the right. As a result, a reaction force is transmitted to the user and to the body engaging member 36 through the right link 152, which is connected to right foot support 38 and the body engaging member. Thus, the pushing force by the right foot on the right foot support 38 provides a reaction force that causes the user and the body engaging member 36 engaged by the user to begin moving to the left. It should be noted that FIG. 9 shows the position of the elements of linkage system 150 when the user of the exercise device is in the position shown in FIG. 18.

Figure 19:
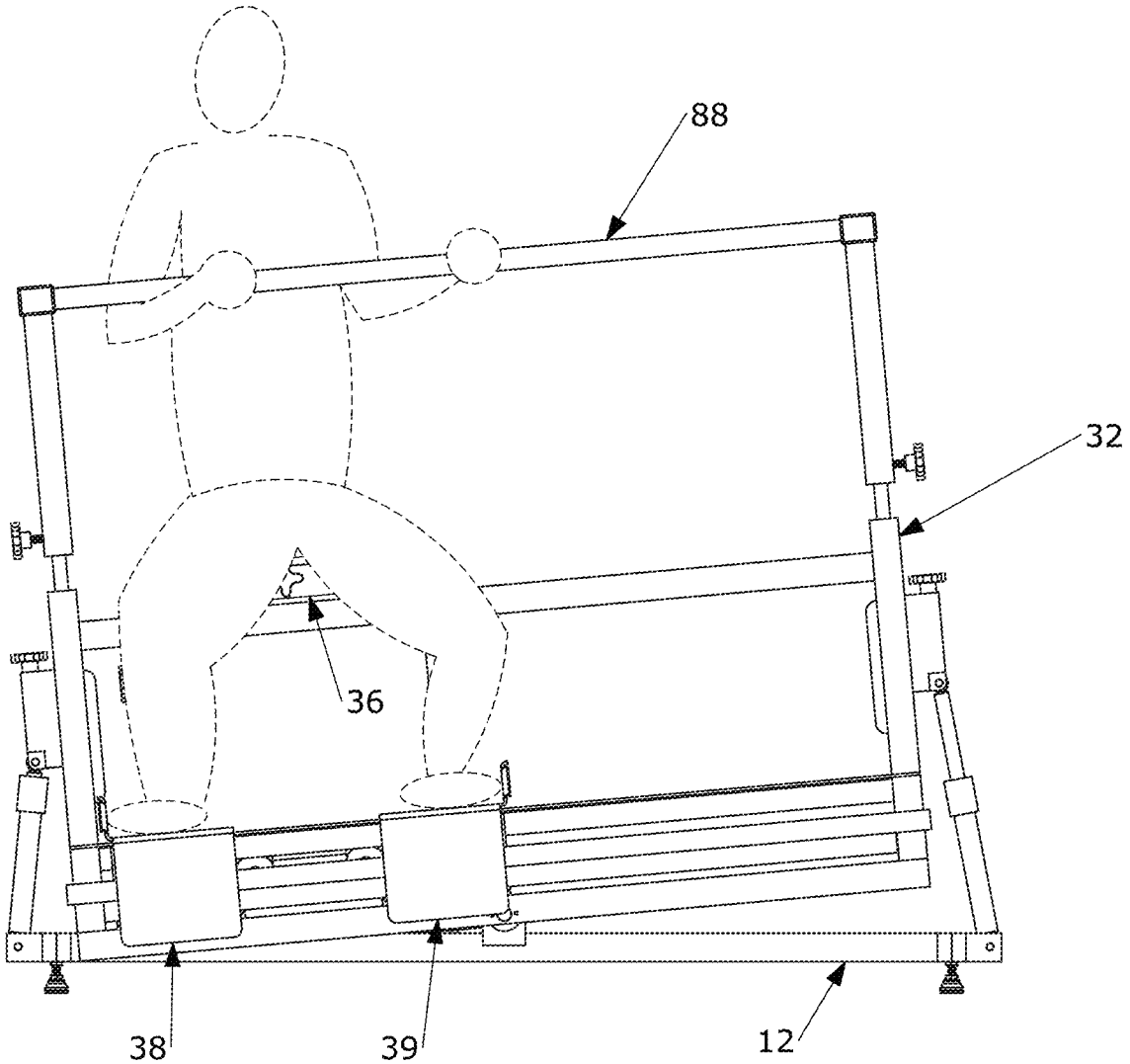
FIG. 19 is a view similar to FIG. 18, and showing the initial movement of one of the foot supports relative to the other foot support at the beginning of the exercise.
Figure 20:
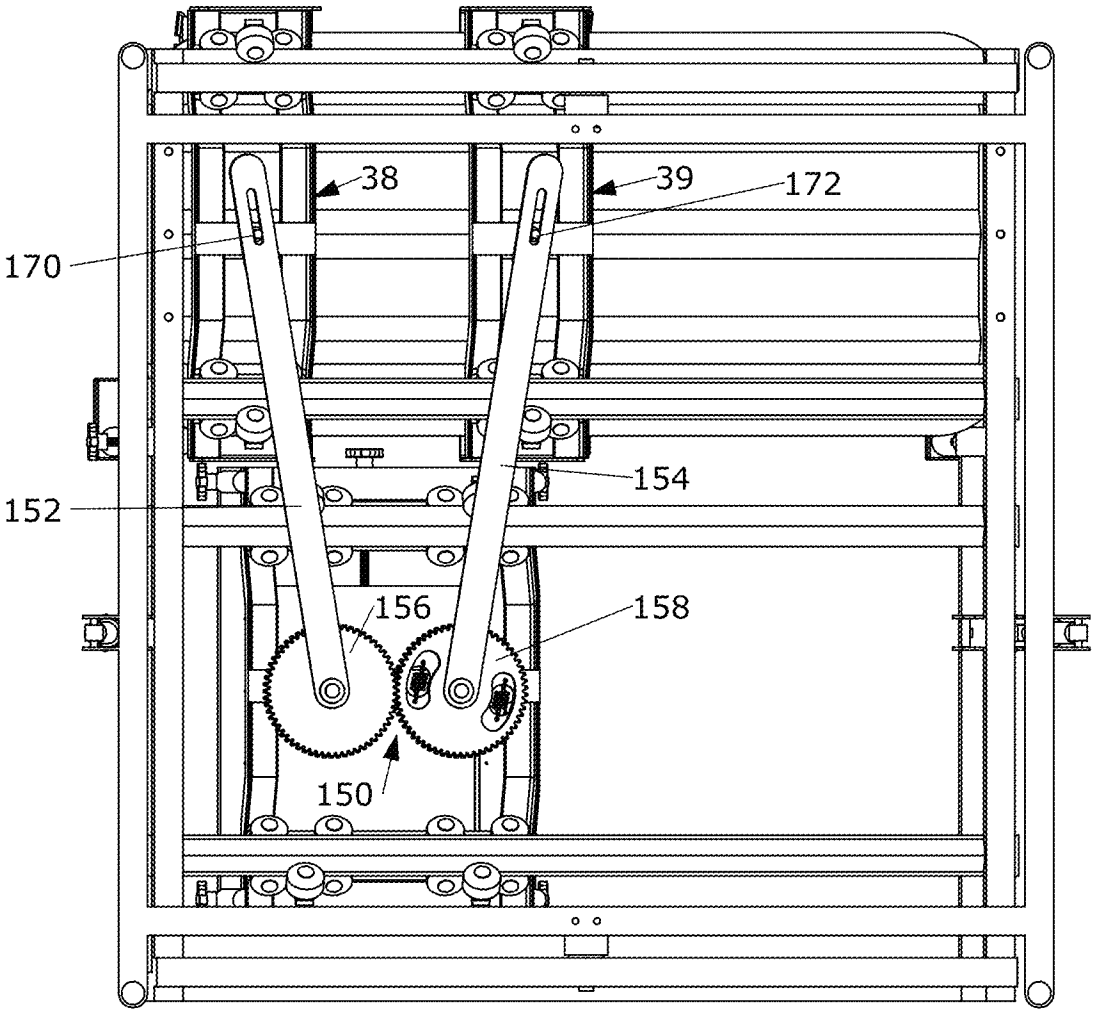
FIG. 20 is a bottom view of the exercise device, showing the position of the connecting linkage system with the foot supports and body engaging member in the positions shown in FIG. 19.

Referring to FIGS. 19 and 20, the right link 152 moves with the body engaging member 36 as a result of it being connected thereto, and the gear 156 attached to the right link 152 begins to rotate. Rotational movement of gear 156 is transmitted to meshing gear 158 and to the left link 154 connected thereto. Movement of the left link 154 causes the opposed end thereof, which engages pin 172, to move the left foot support 39 further to the left; thereby separating from the right foot support 38, which still is positioned against the right side of the mounting member 32. FIG. 20 shows the position of the elements of the linkage system 150 with the body engaging member 36 and the foot supports 38, 39 in the position shown in FIG. 19.

Figure 21:
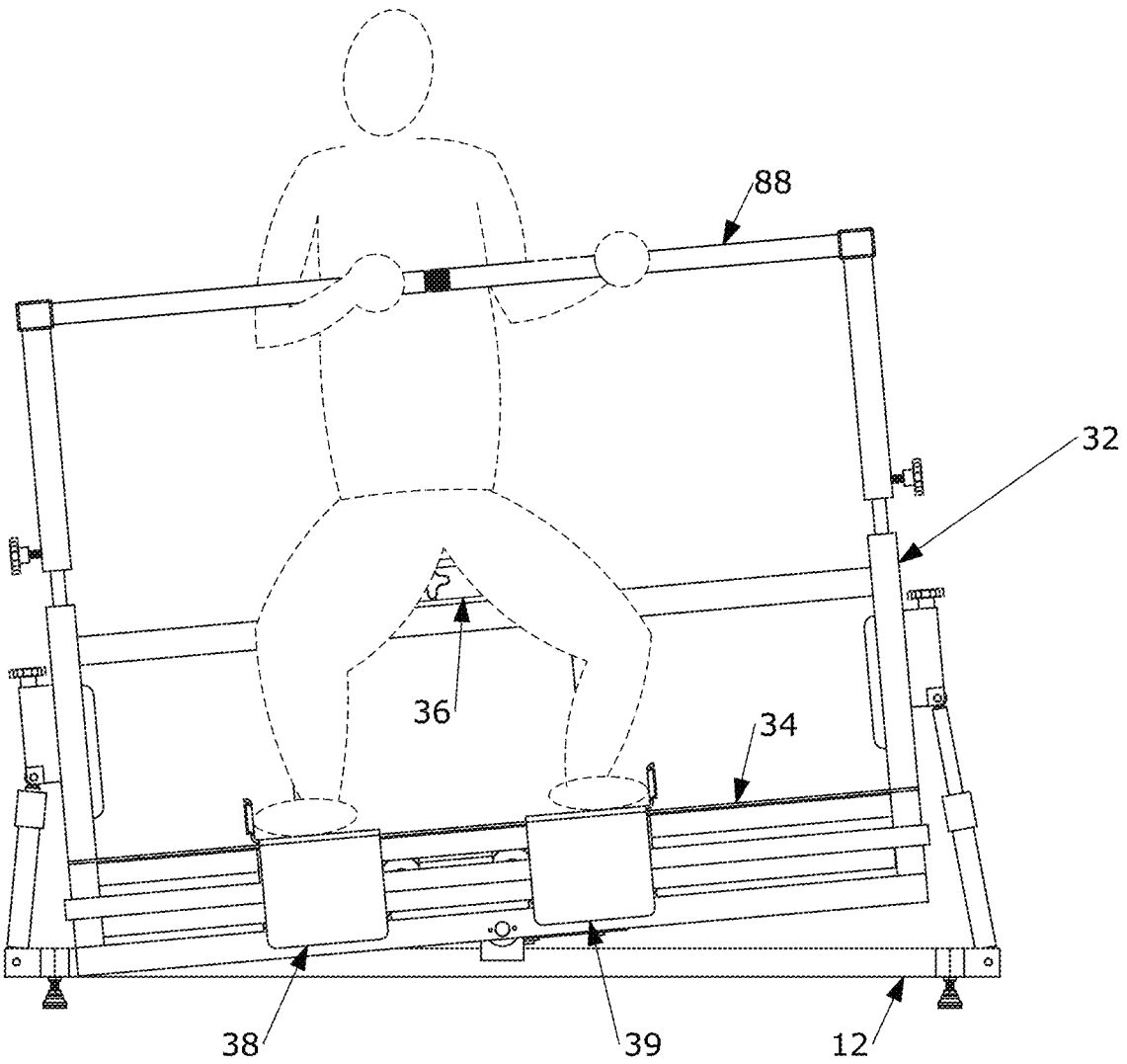
FIG. 21 is a view similar to FIG. 18, during a further stage of the exercise.
Figure 22:
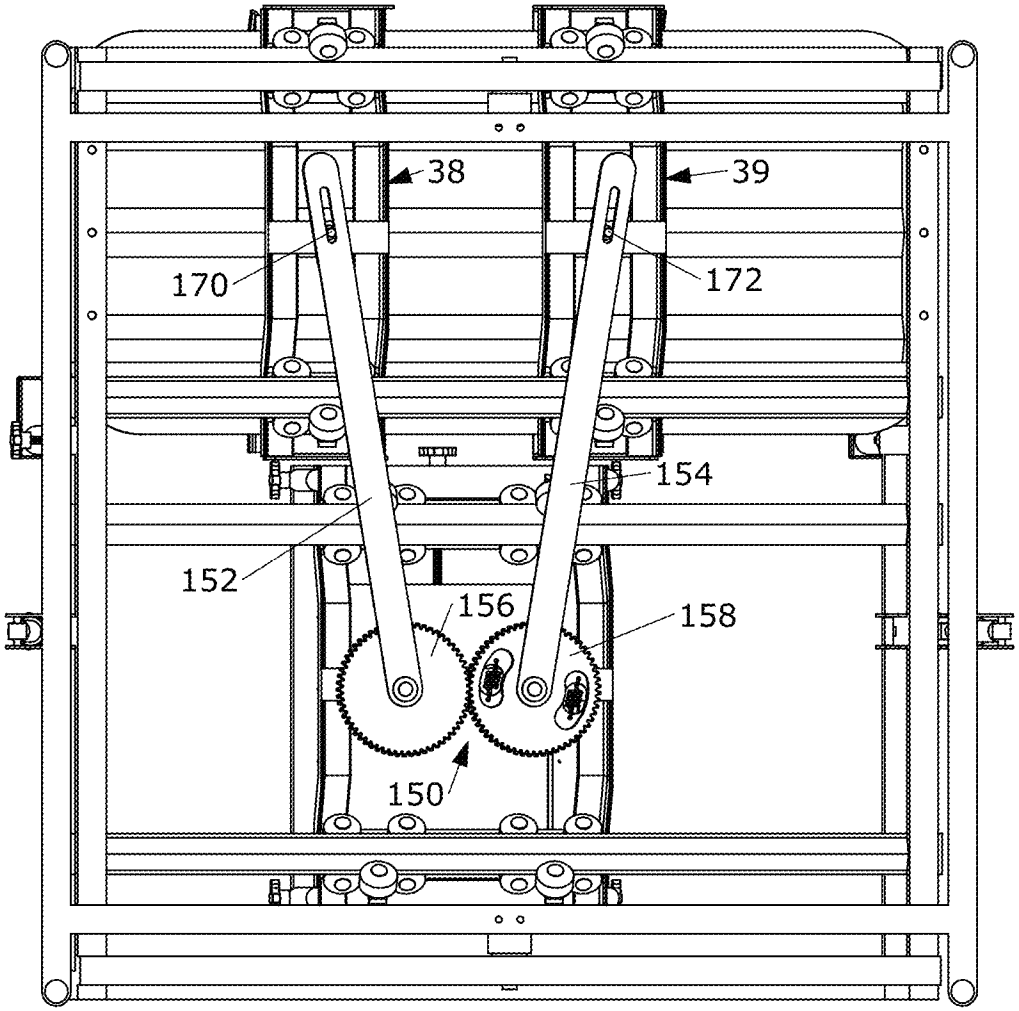
FIG. 22 is a bottom view of the exercise device, showing the position of the connecting linkage system with the foot supports and body engaging member in the positions show in FIG. 21.

Referring to FIGS. 21 and 22, during continued movement to the left, the right foot support 38 begins movement to the left on the mounting member 32 and the force imposed on the foot supports 38, 39 by the legs causes both the body engaging member 36 and the left foot support 39 to continue to move to the left on the elongate guide 34 in an upwardly inclined path. FIG. 22 shows the position of the elements of the linkage system 150 with the body engaging member 36 and the foot supports 38, 39 in the position shown in FIG. 21.

Figure 23:
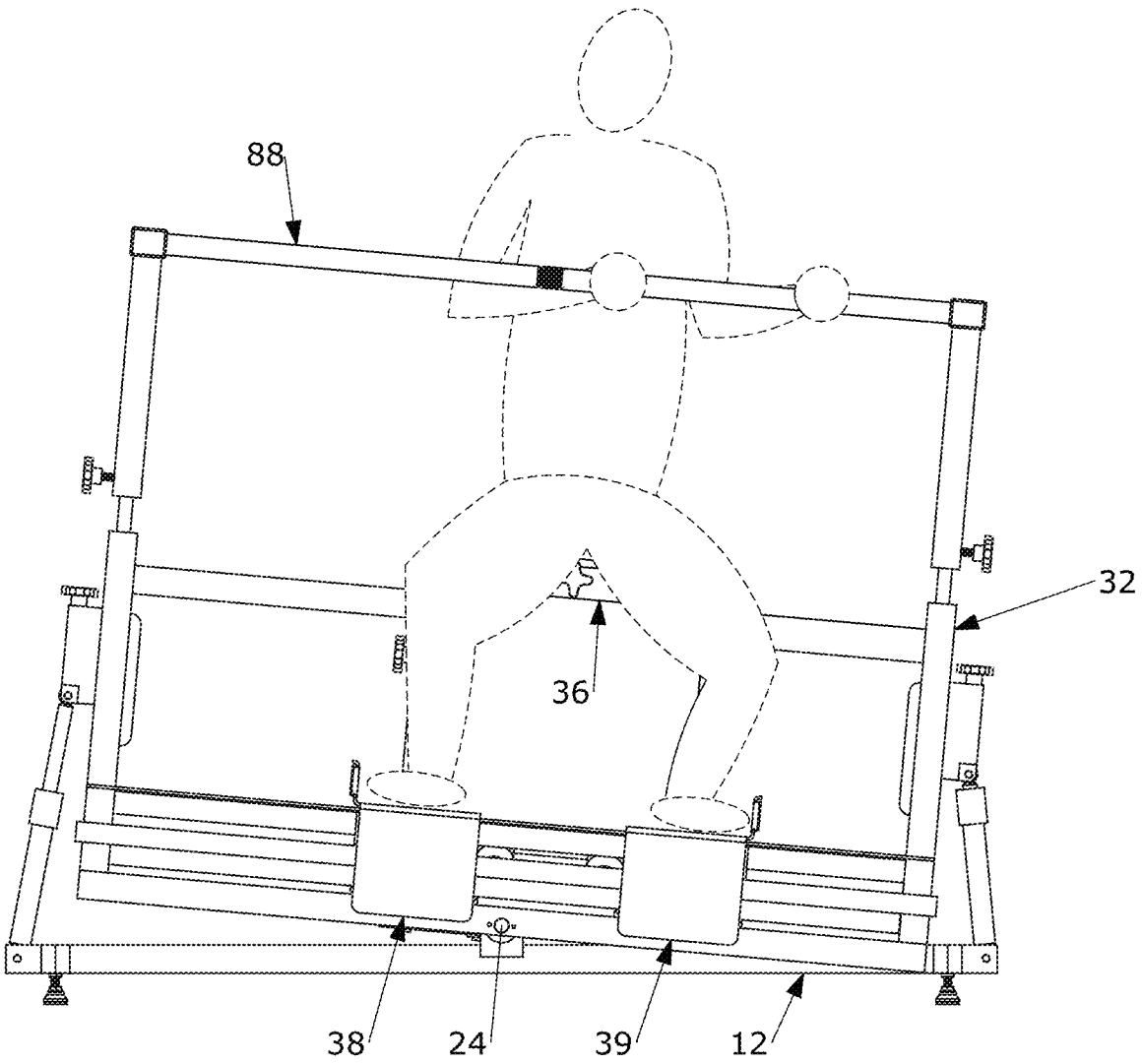
FIG. 23 is a view similar to FIG. 18, during yet a further stage of the exercise.
Figure 24:
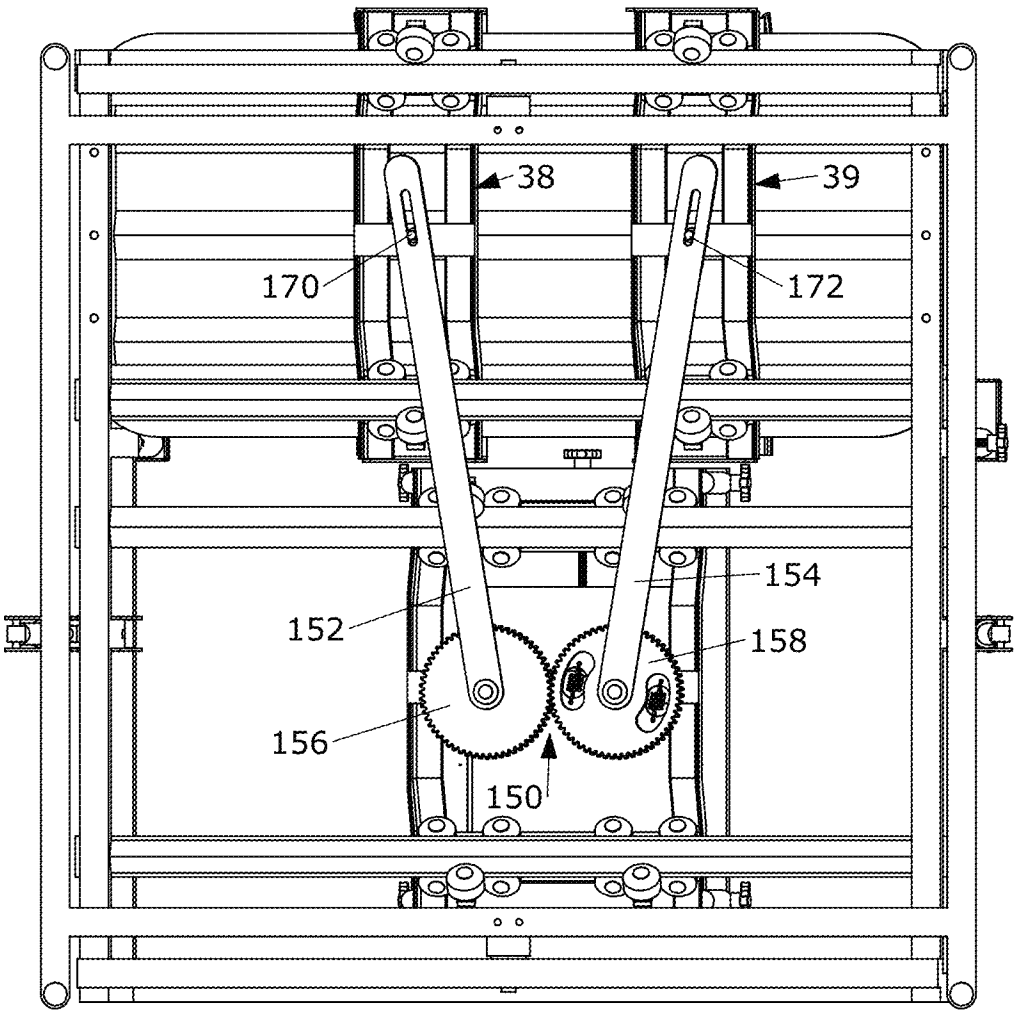
FIG. 24 is a bottom view of the exercise device, showing the position of the connecting linkage system with the foot supports and body engaging member in the positions shown in FIG. 23.

Referring to FIGS. 23, 24, the user passes over the pivot axis provided by axles 24, 26, and the mounting member 32 rotates about the axles 24, 26. This places the body engaging member 36 in a downwardly inclined position to the left. FIG. 24 shows the position of the elements of the linkage system 150 with the body engaging member 36 and the foot supports 38, 39 in the position shown in FIG. 23.

Figure 25:
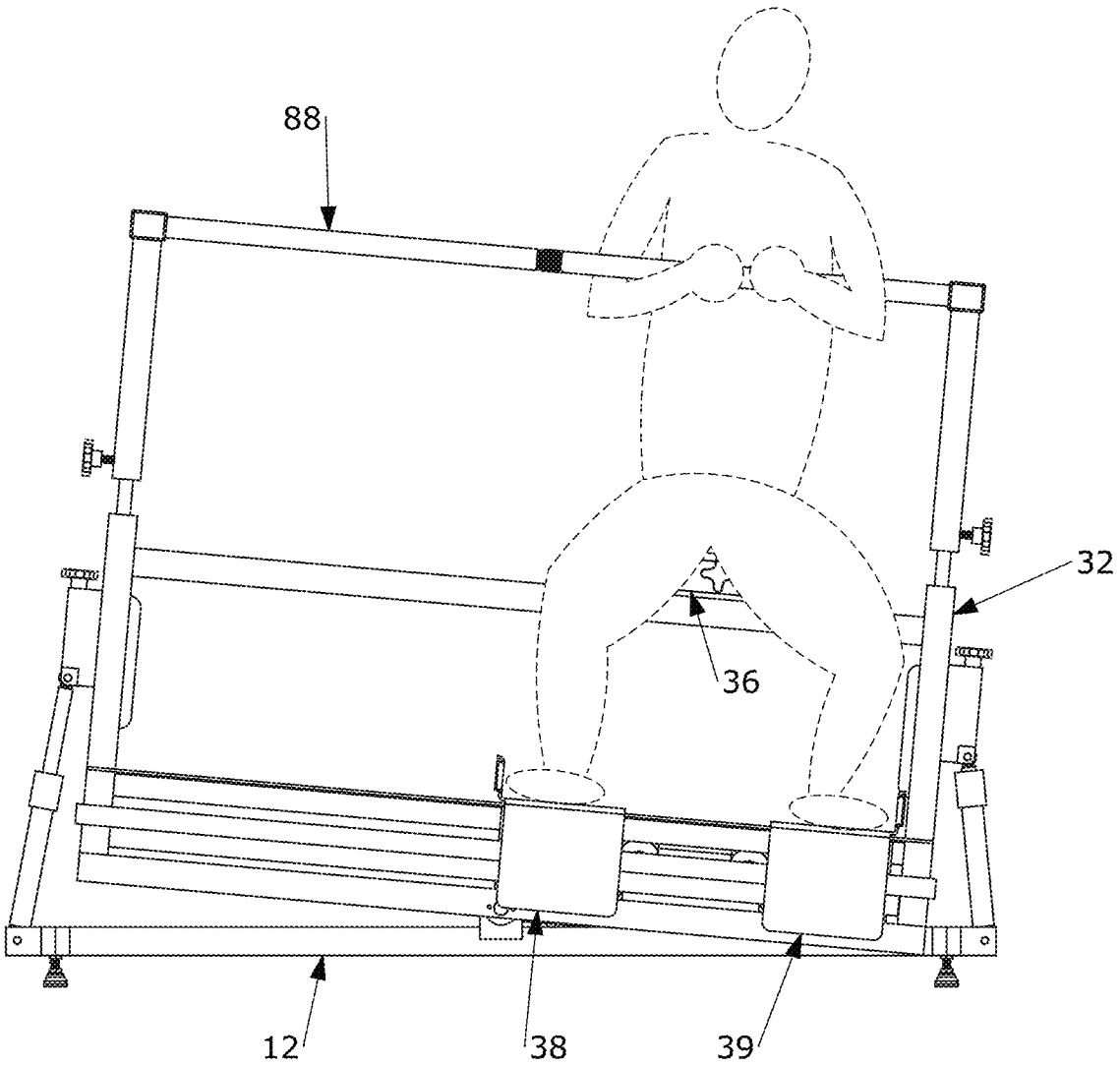
FIG. 25 is a view similar to FIG. 18, during yet a further stage of the exercise.
Figure 26:
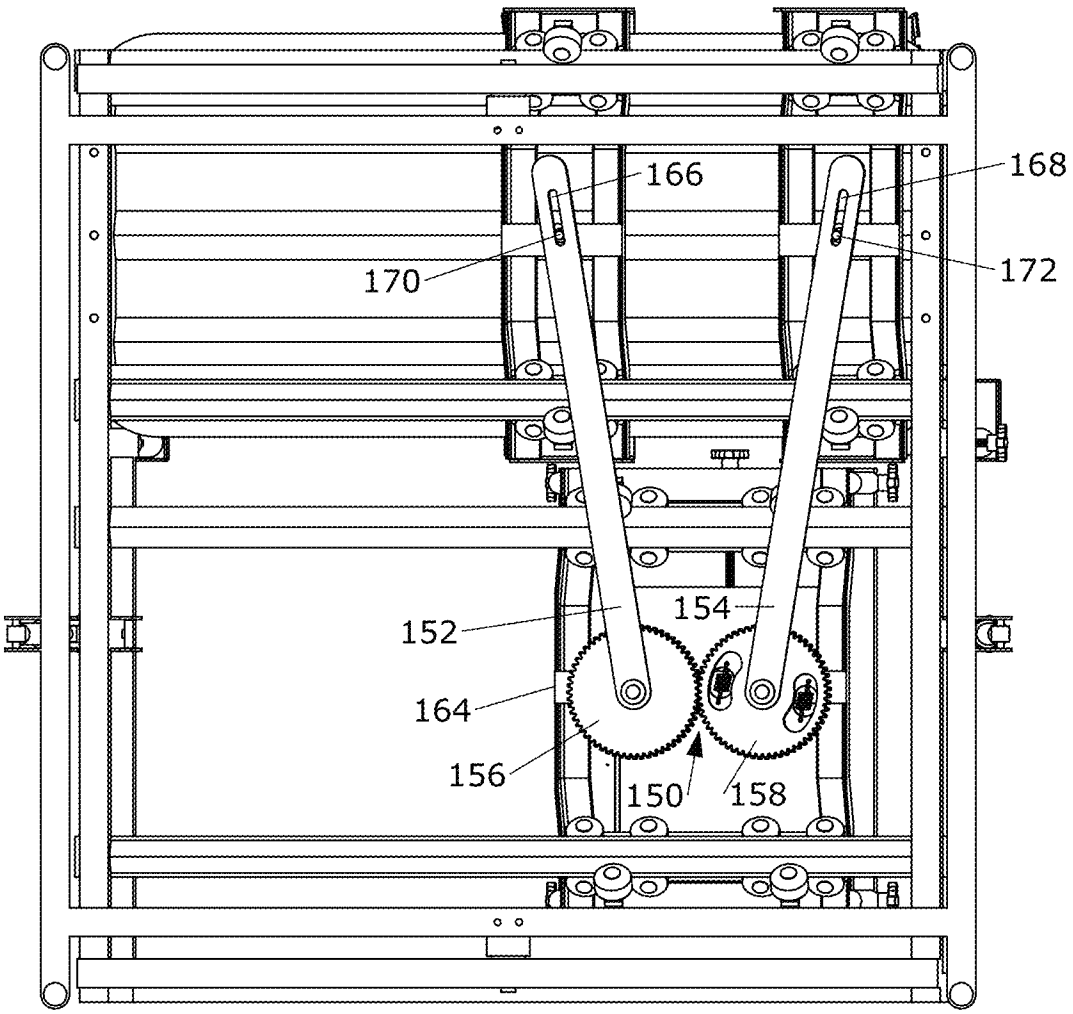
FIG. 26 is a bottom view of the exercise device, showing the position of the connecting linkage system with the foot supports and body engaging member in the positions shown in FIG. 25.

Referring to FIGS. 25, 26, the left foot support 39 continues to move to the left, until it engages the left end of the mounting member 32. When the left foot support initially engages the left end of the mounting member 32 both the body engaging member 36 and right foot support 38 are still spaced from the left end of the mounting member 32, as shown in FIG. 25. FIG. 26 shows the position of the elements of the linkage system 150 with the body engaging member 36 and the foot supports 38, 39 in the position shown in FIG. 25.

Figure 27:
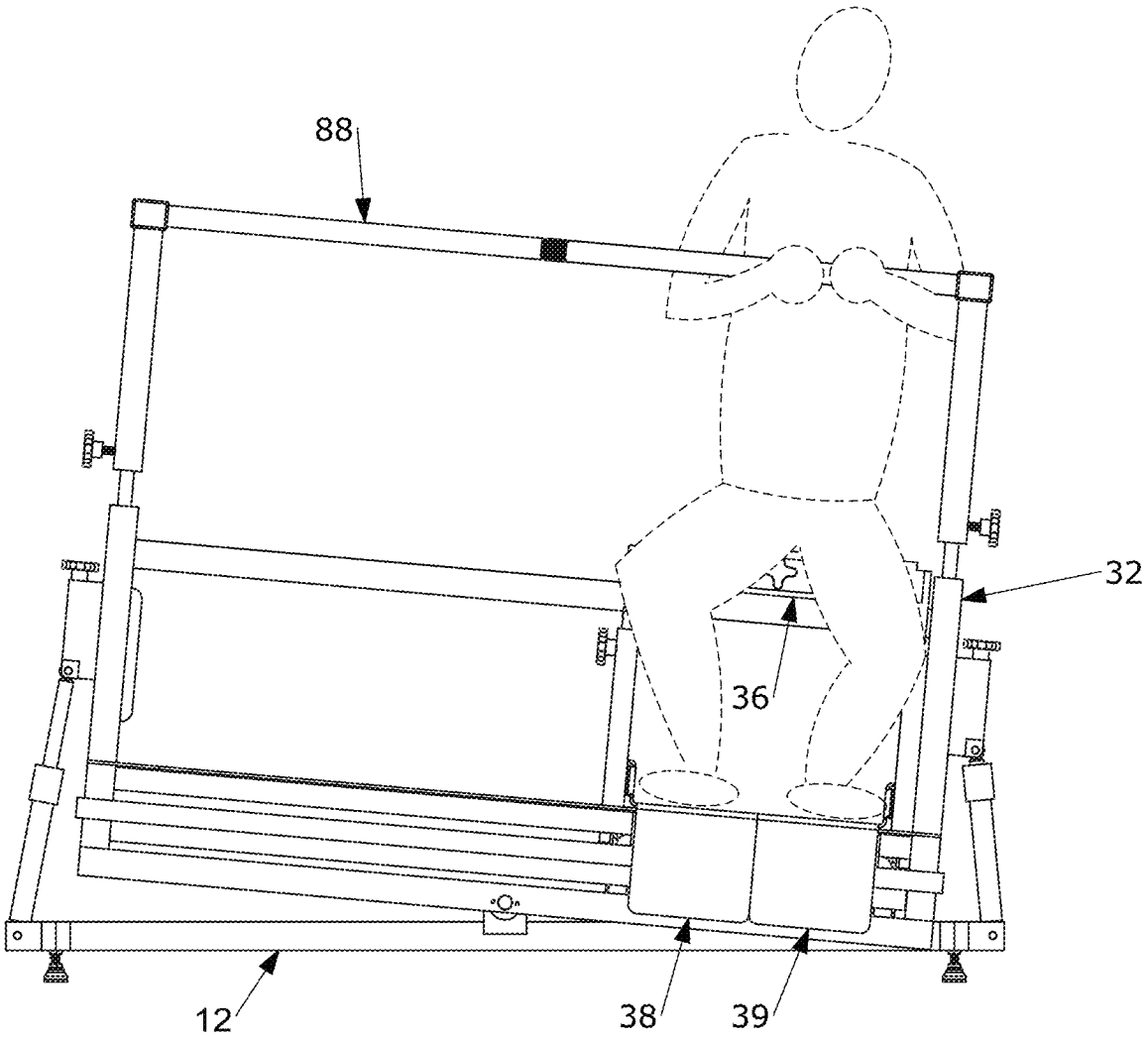
FIG. 27 is a view similar to FIG. 18, but with both foot supports and the body engaging member at the longitudinal end of the device opposite from that shown in FIG. 18.
Figure 28:
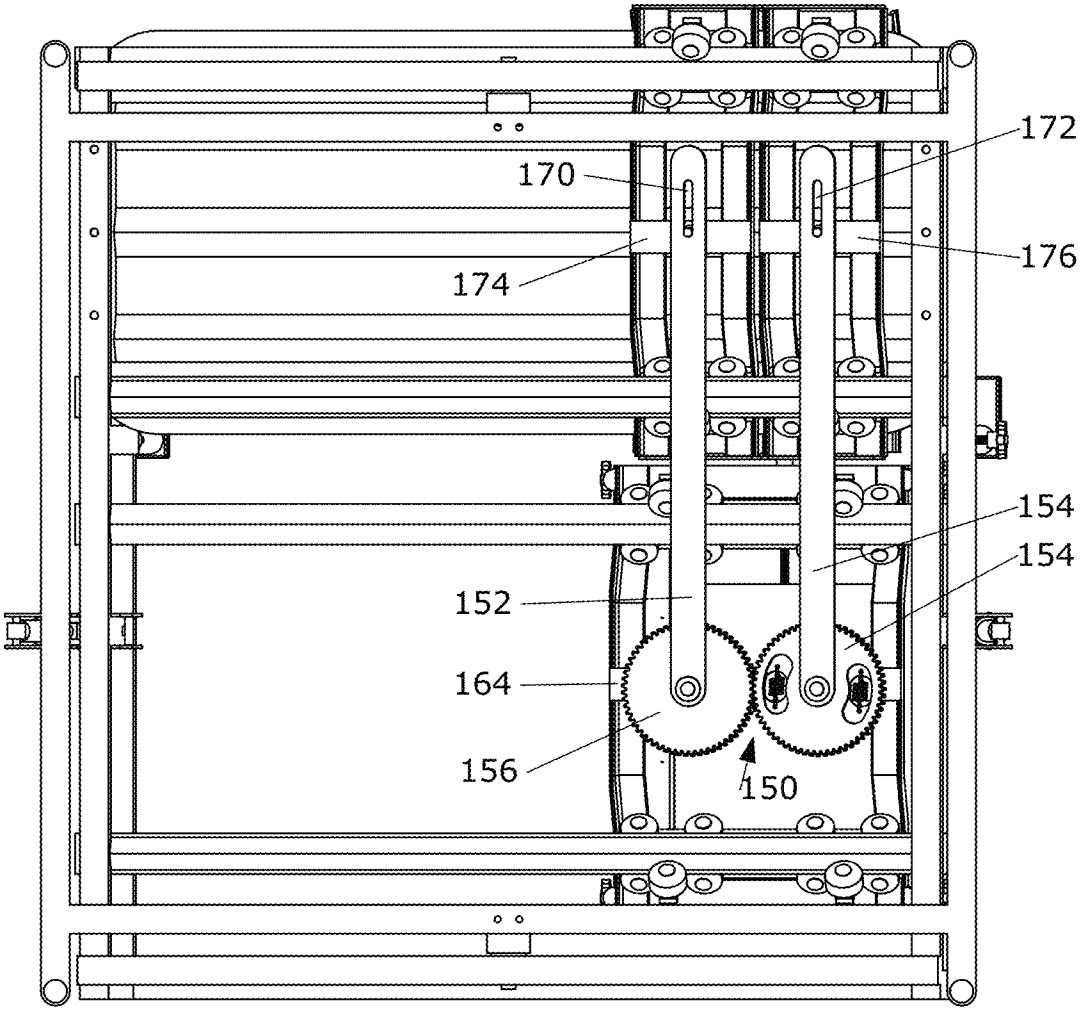
FIG. 28, is a bottom view of the exercise device, showing the position of the connecting linkage system with the foot supports and body engaging member in the positions show in FIG. 27.

Referring to FIGS. 27, 28, in the final, left position, the right foot support 38 moves to its final left position closely adjacent the left foot support 39 and the body engaging member 36 completes its movement to the left, as shown in FIG. 27. FIG. 28 shows the position of the elements of the linkage system 150 with the body engaging member 36 and the foot supports 38, 39 in the position shown in FIG. 27.

As a result of the interconnection of the linkage system 150 with the foot supports 38, 39 and the body engaging member 36, the left foot support 39 moves at twice the speed as the body engaging member 36 including the seat 40, because movement of the body engaging member 36 is caused only by the rotation of the right link 152, whereas movement of the left foot support 39 results from rotational movement of both links 152, 154.

It also should be noted that the user can engage the rail 88 formed by the locked arm segments 94, 96 to aid in propelling the user longitudinally along the exercise device. Alternatively, when the arm segments 94, 96 are on each side of the body engaging member 36, as shown in FIG. 35, they can be engaged by the user to push or pull himself/herself longitudinally along the exercise device.

To move from left to right in the exercise device 10 the same steps are provided as discussed above but in opposite directions. For purposes of brevity this movement in the opposite direction will not be described. However, it should be noted that in the movement from left to right, the right foot support 38 moves at twice the speed as the body engaging member 36 because movement of the body engaging member is caused only by the rotation of the left link 154, whereas movement of the right foot support results from the rotational movement of both links 152, 154.

Although the linkage system 150 provides the desire relative movement among the foot supports 38, 39 and the body engaging member 36, the end of the elongate links 152, 154 including the elongate slots 166, 168 therein is unsupported. The lack of support for the links 152, 154 provides a less than perfect connection for the moveable components of the linkage system. However, it should be emphasized that the linkage system provides the desire relative movement among the foot supports 38, 39 and the body engaging member.

Referring to FIGS. 37-40, a more preferred linkage system 150*a* is disclosed. It should be noted that the linkage system 150*a* provides the same relative movement of the foot supports 38, 39 and the body engaging member 36 as the linkage system 150. Therefore, the manner of operation of the linkage system 150*a* during different phases of a sliding exercise will not be repeated since it is the same as the manner of operation of the linkage system 150 described earlier. As will be disclosed in detail below, the major difference between linkage system 150 and 150*a*, is that the arrangement of pins 170, 172 extending into slots 166, 168 has been eliminated in the linkage system 150*a* to thereby provide or more stable and rugged system than linkage system 150.

Figure 38:
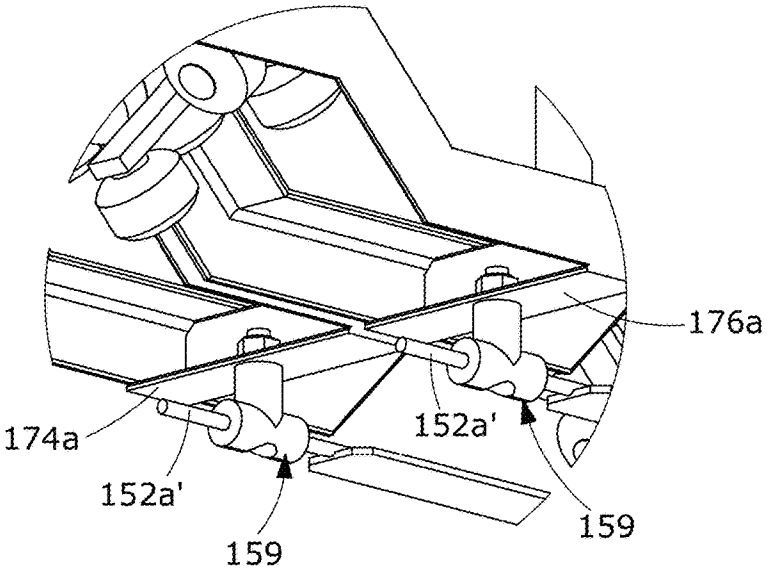
FIG. 38 is an enlarged view of the section circled in FIG. 37 and identified as 38.
Figure 37:
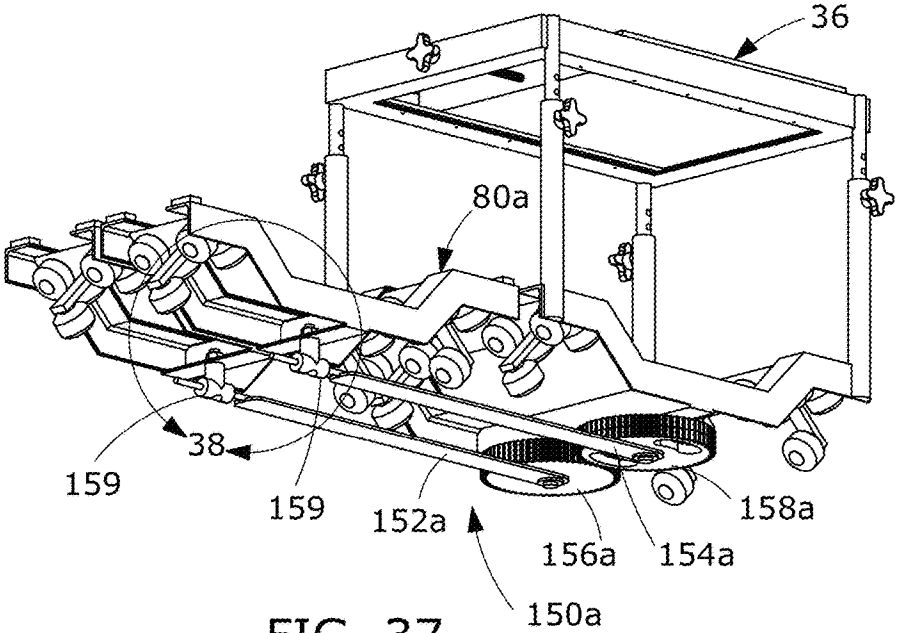
FIG. 37 is an isometric view showing a preferred linkage system interconnecting the body engaging member and the carriage or bracket for the foot supports.
Figure 39:
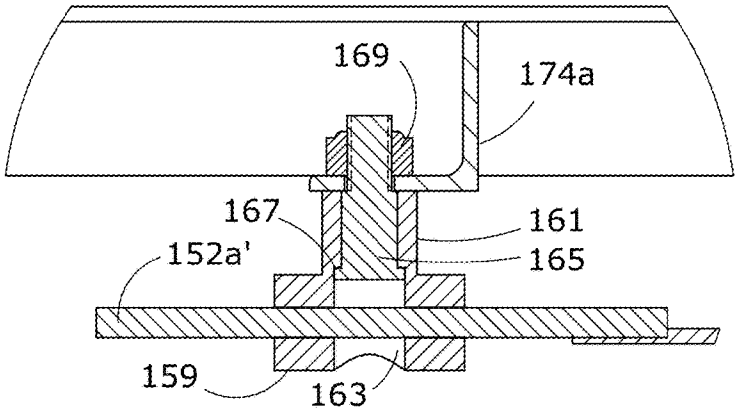
FIG. 39 is a cross-sectional view showing the bearing slidable on a rail of one of the links and showing details of the rotatable connection of the bearing to a strut forming part of a carriage or bracket for a foot support.
Figure 40:
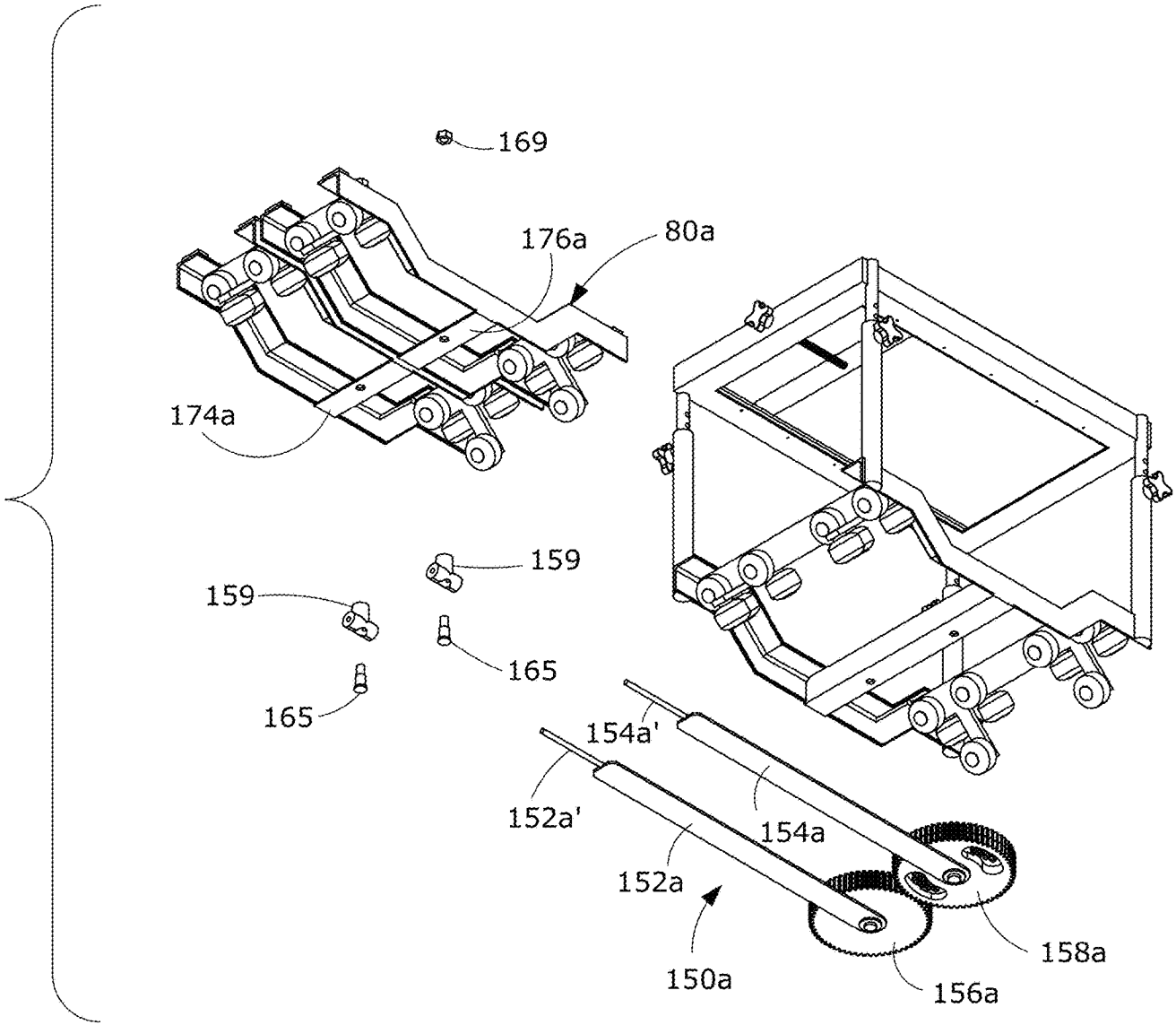
FIG. 40 is an exploded isometric view of the elements shown in FIG. 37.

Referring to FIGS. 37-39, the linkage system 150*a* includes a pair of elongate links 152*a*, 154*a*. Gears 156*a* and 158*a* are provided at one end of the links 152*a*, 154*a*, respectively, and are identical to the gears 156 and 158 employed in the linkage system 150. The gears 156*a*, 158*a* provide the same function and operate in the same way as the gears 156 and 158, and therefore the structure and function of gears 156*a*, 158*a* will not be repeated herein.

The major distinction between links 152*a* and 154*a*, on the one hand, and links 152 and 154, on the other hand, is that the ends of links 152*a*, 154*a* are provided by elongate rails 152*a*', 154*a*' in place of the elongate slots 152, 154 provided in the elongate links 156, 158. As shown in the illustrated embodiment the elongate rails 152*a*' and 154*a*' are in the form of elongate rods connected by any suitable means, such as weldments, to a section of the links 152*a*, 154*a* to which gears 156*a*, 158*a* are attached. It should be noted that the rails 152*a*', 154*a*' can be of other configurations. For example, they can be an elongate flat member attached adjacent to the forward end of the section of the elongate links to which gears 156*a*, 158*a* are attached, and an elongate rail section can extend upwardly from the flat member and be of any desired shape, e.g., semi-circular in cross section, T-shaped in cross section, etc. However, providing the rails in the form of rods 152*a*', 154*a*' is a simple construction considered well suited for use in this invention.

Still referring to FIGS. 37-40, a low friction member; most preferably a bearing 159, extends over each of the elongate rails 152*a*', 154*a*' and is mounted for sliding movement along those elongate rails. This sliding movement corresponds to the sliding movement between the downwardly extending pins 170, 172 in elongate slots 166, 168 of the linkage system 150. In otherwards, the movement of the downwardly extending pins 170, 172 in the elongate slots 166, 168 of the linkage system 150 is replaced by sliding movement of low friction members 159 on elongate rails 152*a*', 154*a*'.

Each of the bearings 159, in addition to having a horizontal passage for receiving the elongate rails 152*a*' and 154*a*' therein, also includes a vertically extending hub 161 including a vertical passage 163 extending through the entire bearing for receiving an attachment member 165 in the form of an axle. Each of the axles 165 rotatably supports a corresponding bearing 159, as will be explained in detail hereinafter. Specifically, each axle 165 is inserted into a vertical passage 163 of a corresponding bearing 159 from the bottom thereof, before inserting the elongate rails 152*a*', 154*a*' through the horizontal passages of the corresponding bearings. Each of the axles 165 includes a flange 167 at a lower end thereof, and an upper surface of each flange rotatably engages a downwardly facing, inner surface of the hub of a corresponding bearing 169 when the axles are fully inserted within their respective hubs.

FIGS. 38 and 39 best show details of the connecting arrangement for the bearings 159; it being understood that the connecting arrangement for both bearings 159 is the same. Therefore, the connecting arrangement for only one of the bearings 159 will be described in detail, primarily in connection with FIG. 39. As noted, most clearly in FIGS. 38 and 39, the axles 165, are connected, respectively, at one end to struts 174*a*, 176*a* of lower bracket 80*a* (FIG. 37) connected to the foot supports shown at 38, 39, respectively, as part of the device 10. It should be understood that the same foot supports are included in all embodiments of this invention. A nut 169 is threadedly secured to the upper end of each axle 165 to retain each axle, and the corresponding bearing 159 attached thereto, in a desired vertical position with an upper surface of the hub 161 slidably engaging a downwardly facing surface of strut 174*a*. The bearings 159, in addition to be rotatably mounted on axles 165 to rotate in a horizontal plane, also are designed to slide smoothly on the rails 152*a*', 154*a*' during relative movement of the body engaging member 36 and foot supports 38, 39, as described in connection with the operation of the linkage system 150 in device 10.

Desirably the bearings 159 are made from a low friction, plastic material, such as Teflon to permit low friction rotation between engaging surfaces of each bearing and its corresponding axle 165. However, if it desired to further minimize friction between adjacent surfaces of the axles 165 and bearings 159 that rotate relative to each other, suitable bearings can be included between such surfaces.

Figure 43:
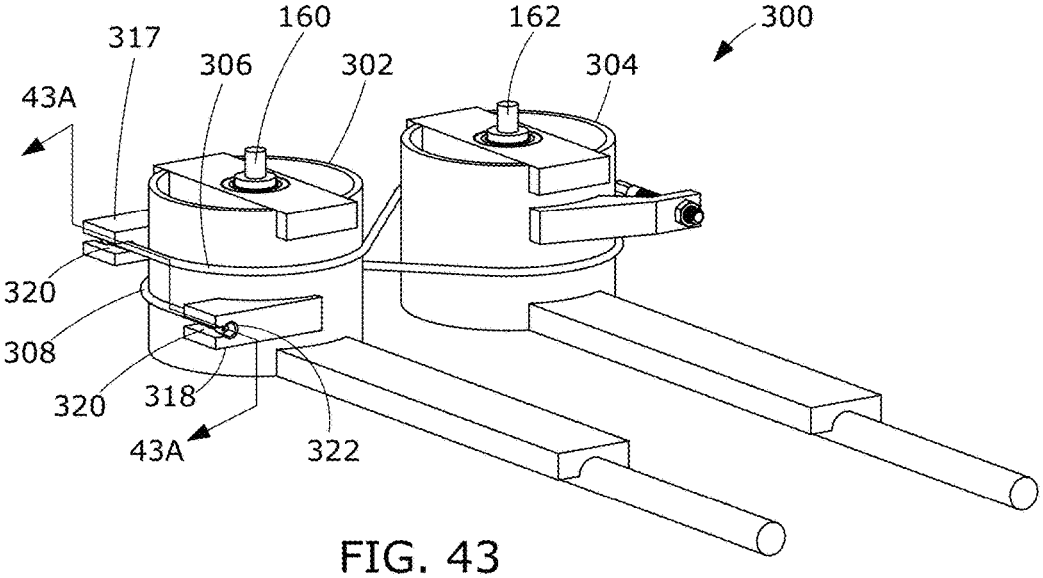
FIG. 43 is a left perspective view showing a pulley arrangement that preferably is used in this device.
Figure 44:
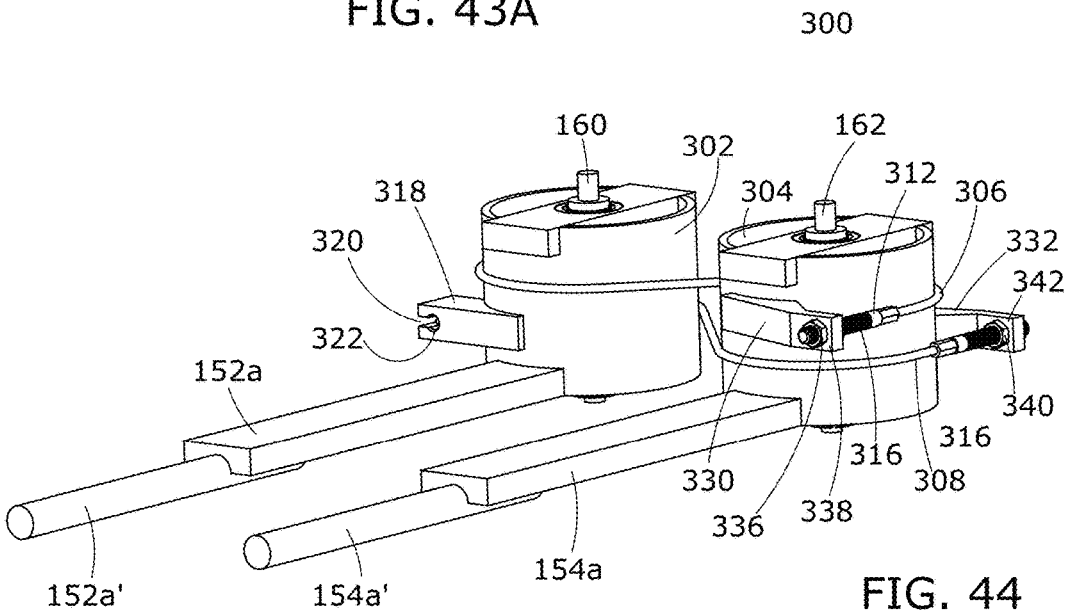
FIG. 44 is a right perspective view showing of the pulley arrangement shown in FIG. 43.
Figure 45:
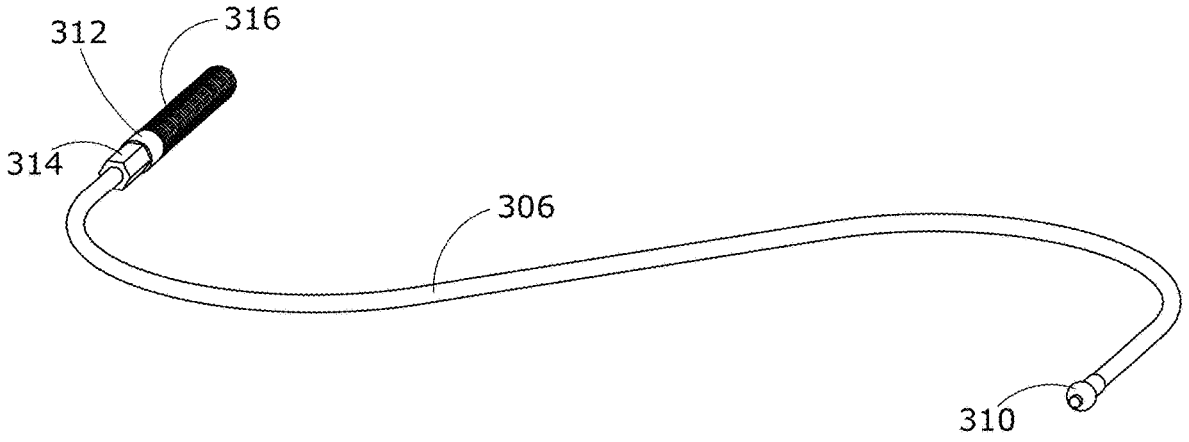
FIG. 45 is a perspective view of a pulley drive belt employed in this invention, it being understood that both pulley drive belts are of the same construction.

Referring to FIGS. 43-45, a pulley arrangement 300 can be employed in place of the meshing gears 156, 158 in all of the above-disclosed embodiments of this invention to provide the same cooperative movements described above in connection with the use of the gears 156, 158.

Referring to FIG. 43, the pulley arrangement 300 includes a pair of pulleys 302, 304 rotatable about axles 160, 162 in the same manner that the gears 156, 158 are mounted to such axles. The pulleys 302, 304, are interconnected by a pair of drive belts 306, 308 of identical construction to transmit rotational movement from each of the pulleys 302, 304, to the other, respectively. The drive belts 306, 308 transmit rotational movement from each pulley 302, 304 to the other in the way that the meshing teeth of gears 156, 158 transmit rotational movement from each gear to the other.

Referring to FIGS. 43 and 44, elongate links 152*a*, 154*a* are secured, e.g., by welding to the pulleys 302, 304, respectively, and each of the links includes an elongate rail 152*a*', 154*a*' as an extension therefrom. These links and rails are the same as described earlier in connection with FIGS. 37-40 and therefore are identified by the same numerals. The elongate rails 152*a*' and 154*a*' are mounted for sliding movement in low friction members 159 in the same manner as described in connection with FIGS. 37-40 to provide the same cooperative movement between the elongate links 152, 154, foot supports and body supports as described in connection with the embodiment of the invention disclosed in FIGS. 37-40, and therefore, for purpose of brevity, that description will not be repeated herein.

It should be noted that the pulleys 302, 304 also can be employed with elongate links 152, 154 including elongate slots 166, 168 therein.

Referring to FIG. 45, the drive belts (only one being shown at 306) are of an identical, known construction including interior metal strands enclosed by an outer plastic cover. The outer cover is stripped at opposed ends to expose the metal strands. A spherical ball member 310 and a threaded member 312 are secured to the metal strands at the opposed ends of the drive belts, respectively. The threaded member 312 includes a rear, hexagonal nut 314 and a forward threaded stem 316. This construction is known in the art.

Figure 43A:
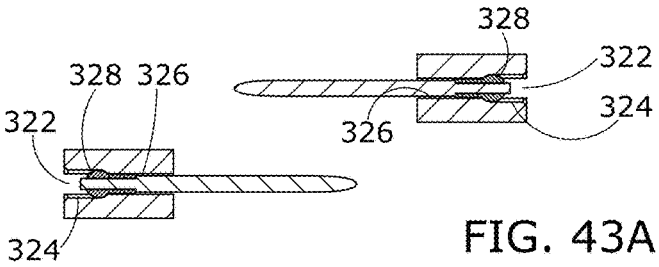
FIG. 43A is a sectional view taken along line 43A-43A of FIG. 43.

Referring to FIGS. 43, 43A and 44, the manner in which the drive belts 306, 308 are connected to the pulleys 302, 304 will be described.

Referring first to FIGS. 43 and 43A, the pulley 302 includes spaced-apart retaining members 317, 318 for receiving and retaining the end of the drive belts 306, 308 that include the spherical ball member 310 thereon. The retaining members 317, 318 can be secured to the outer wall of the pulley 302 in any desired manner, e.g., by welding. The specific manner of attaching or forming the retaining members 317, 318 to or with the pulley does not constitute a limitation on the scope of this invention. Specifically, each of the retaining members 317, 318 is of an identical construction, including an elongate, entrance slot 320 for receiving the drive belts 306, 308 therein. The spherical ball members 310 of the drive belts 306, 308 are two large to be received through the entrance slots 320 of the retaining members 317, 318, and therefore are spaced outwardly from the ends of the slots when the drive belts 306, 308 are inserted into their respective slots. Extending inwardly and in communication with the entrance slot 320 of each retaining member 317, 318 is an internal passage 322. As can be seen best in FIG. 43A, the internal passage 322 of each retaining member 317, 318 has an outer end segment 324 of a circular cross-section sufficiently large to receive the spherical ball member 310 therein. The outer end segment 324 tapers to provide an inner segment 326; said outer and inner segments including a connecting, tapering engagement surface 328 for engaging and retaining the spherical ball member 310 within each of said retaining members.

Referring to FIG. 44, the pulley 304 includes spaced-apart retaining members 330, 332 of identical construction; each including a passage for receiving the forward threaded stem 316 of the threaded member 312. The passage in each retaining member 330, 332 is not threaded but does closely conform in shape and dimension to the threaded stem 316 extending therethrough.

Still referring to FIG. 44, after each of the threaded stems 316 is inserted through a respective passage of retaining members 330, 332, an outer nut 336 (only one being shown)

is threaded onto the distal end of each of the thread stems and tightened. When the outer nuts 336 engage outer surfaces 338 of retaining members 330, 332, respectively, further rotation of the outer nuts 336 causes the threaded stems 316 to move through the slots to thereby provide a tight, positive rotational-force-transmitting connection between the drive belts 306, 308 and the outer surfaces of the pulleys 302, 304. After a frictionally tight connection is provided, inner nuts 340 (only one being show), which initially were on the rear portion of the threaded stems 316 when the stems were inserted through the passages 334, are tightened against inner surfaces 342 of the retaining members 330, 332. To prevent rotation of the threaded stems 316 of the threaded members 312 when the outer and inner nuts 336, 340 are being rotated into their locking positions, a wrench, pliers, or other retaining tool can be engaged with the rear, hexagonal nut 314 of threaded member 312.

Referring to FIGS. 29-33, an alternate embodiment of exercise device 200 includes base member 202 with leveling feet 204. The base member 202 also includes front and rear frame members 206, 208. Mounts 210, 212 extend up from front and rear frame members 206, 208, respectively, and each mount includes an axle (only one being shown at 214) extending outwardly therefrom and being received in bushing or bearing in front and rear frame members 218, 220 of mounting member 222 to permit reciprocating movement of the mounting member 222 relative to base member 202. It should be noted that the mounting member 222 is mounted to the base member 202 in the same manner that the mounting member 32 is mounted to the base member 12 in the exercise device 10. As in the exercise device 10, the range of reciprocating movement of the mounting member 222 and guide rails 226, 228 thereon in the exercise device 200 can be adjusted for a desired range of reciprocating movement. Also, as in the exercise device 10, the mounting member 222 and guide rails 226, 228 thereon in exercise device 200 can be mounted against reciprocating movement; preferably maintaining the mounting member and guide rails in a horizontal plane during use of the exercise device 200.

Figure 29:
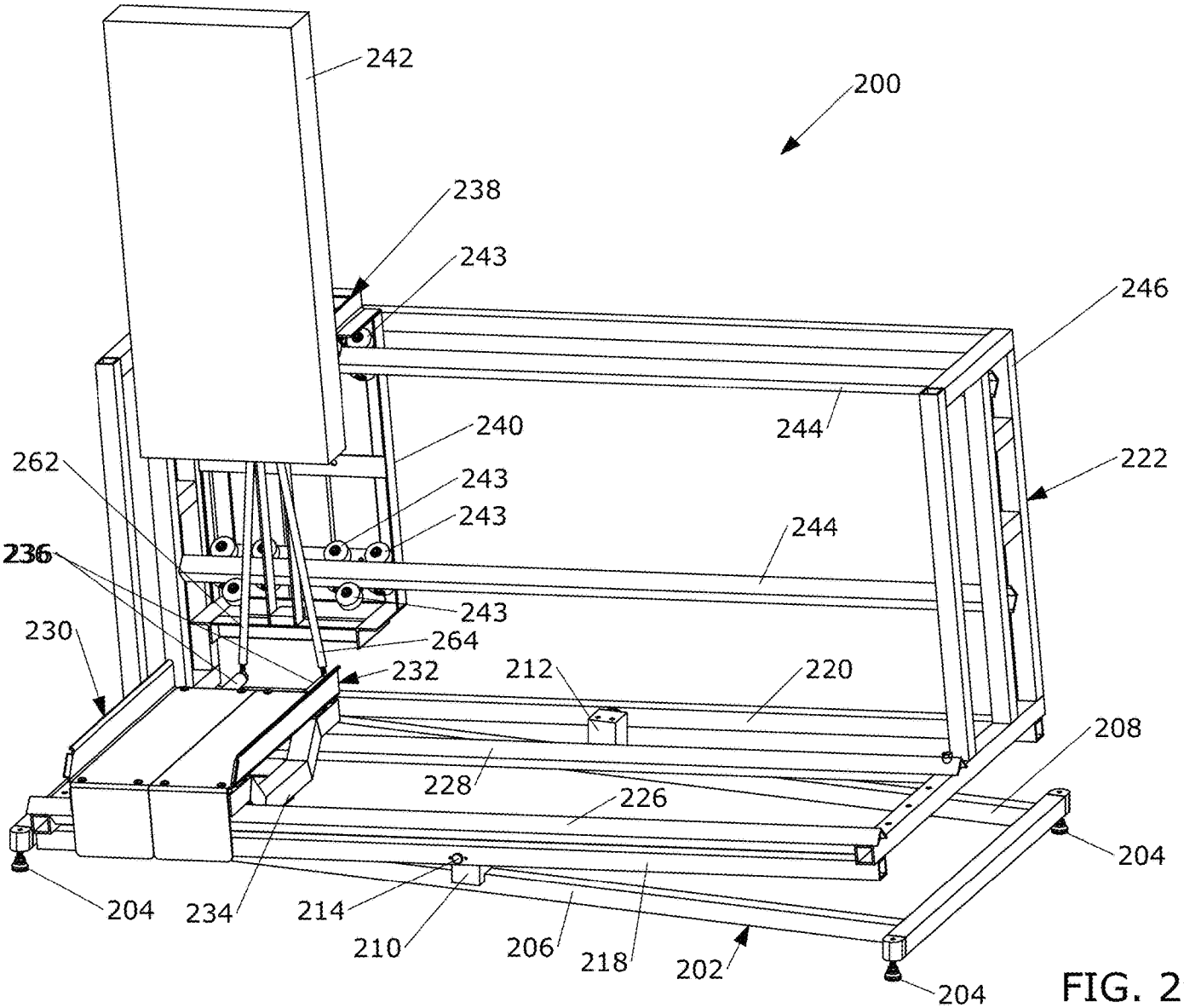
FIG. 29 is a perspective view of a second embodiment of this invention showing the body engaging member in the form of a back support for an individual using the exercise device in a standing position.
Figure 30:
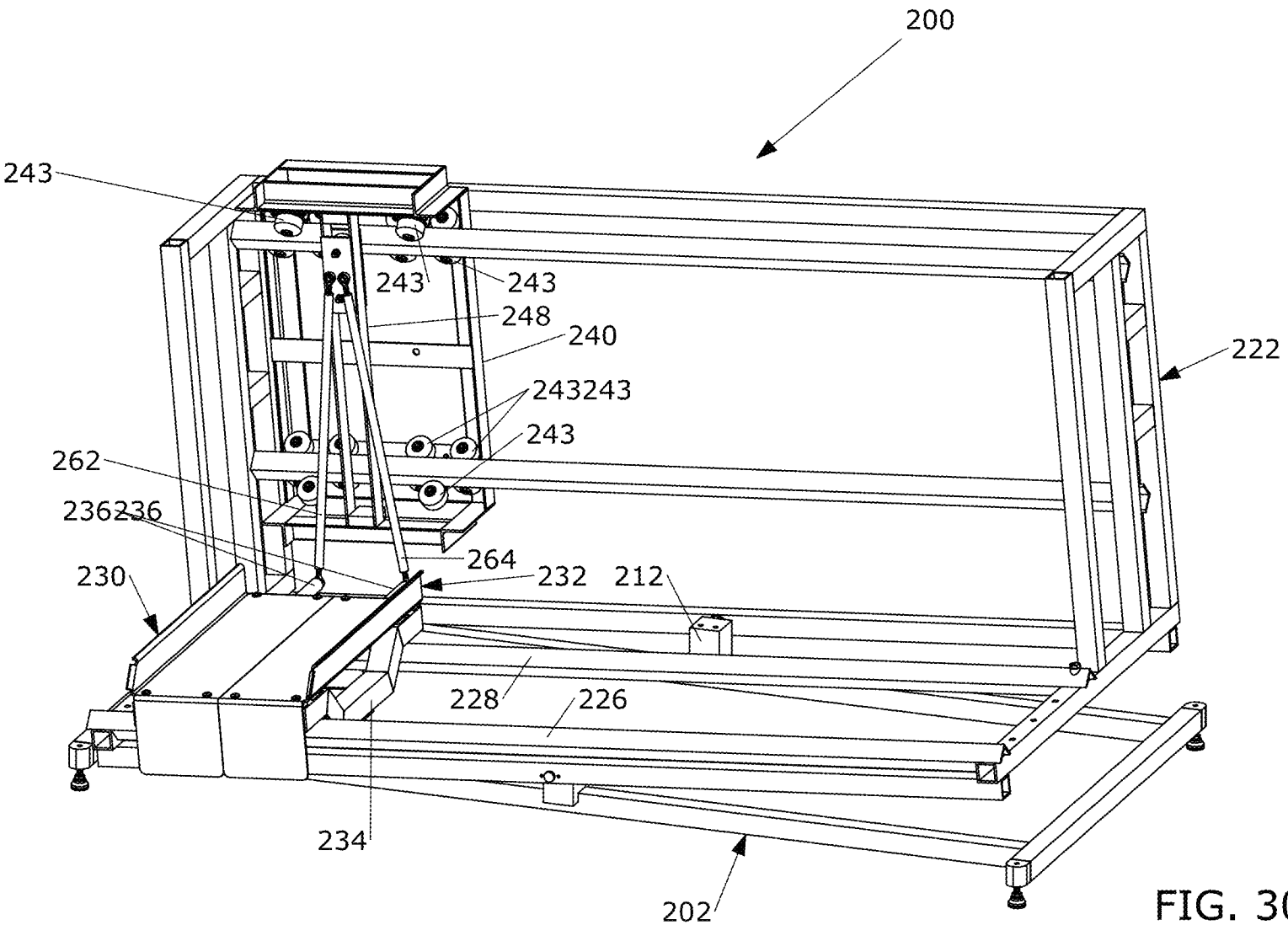
FIG. 30 is a perspective view of the second embodiment of the invention shown in FIG. 29, but with the back support removed to show details of the linkage system.

Referring to FIGS. 29 and 30, the mounting member 222 supports an elongate guide including spaced-apart elongate rails 226, 228 for slidably supporting foot supports 230, 232.

The foot supports 230, 232, are secured to lower brackets 234 that include rollers (not shown) supporting the brackets 234 and the foot supports connected thereto for longitudinal sliding movement on elongate rails 226, 228.

The foot supports 230, 232 and the lower brackets 234 are of the same construction as foot supports 38, 39, with the exception that each foot support 230, 232 includes a member or connector 236 projecting from the rear thereof, rather than extending downwardly therefrom as in foot supports 38, 39, for a purpose to be explained hereinafter.

The lower brackets 234 is of the same construction as lower brackets 80 in exercise device with rollers rotatably attached to the bracket 234 in the same manner as the rollers 82 are attached to lower brackets 80 in the exercise device 10.

Referring to FIGS. 29 and 30, a body engaging member 238 is supported for sliding movement behind or rearwardly of the foot supports 230, 232 and includes a rear frame or carriage 240 to which is secured a back support 242. Rollers 243 are mounted on rear frame 240 and engage vertically spaced-apart longitudinally extending rails 244 secured to rear, upstanding frame section 246 of the mounting member 222.

Figure 31:
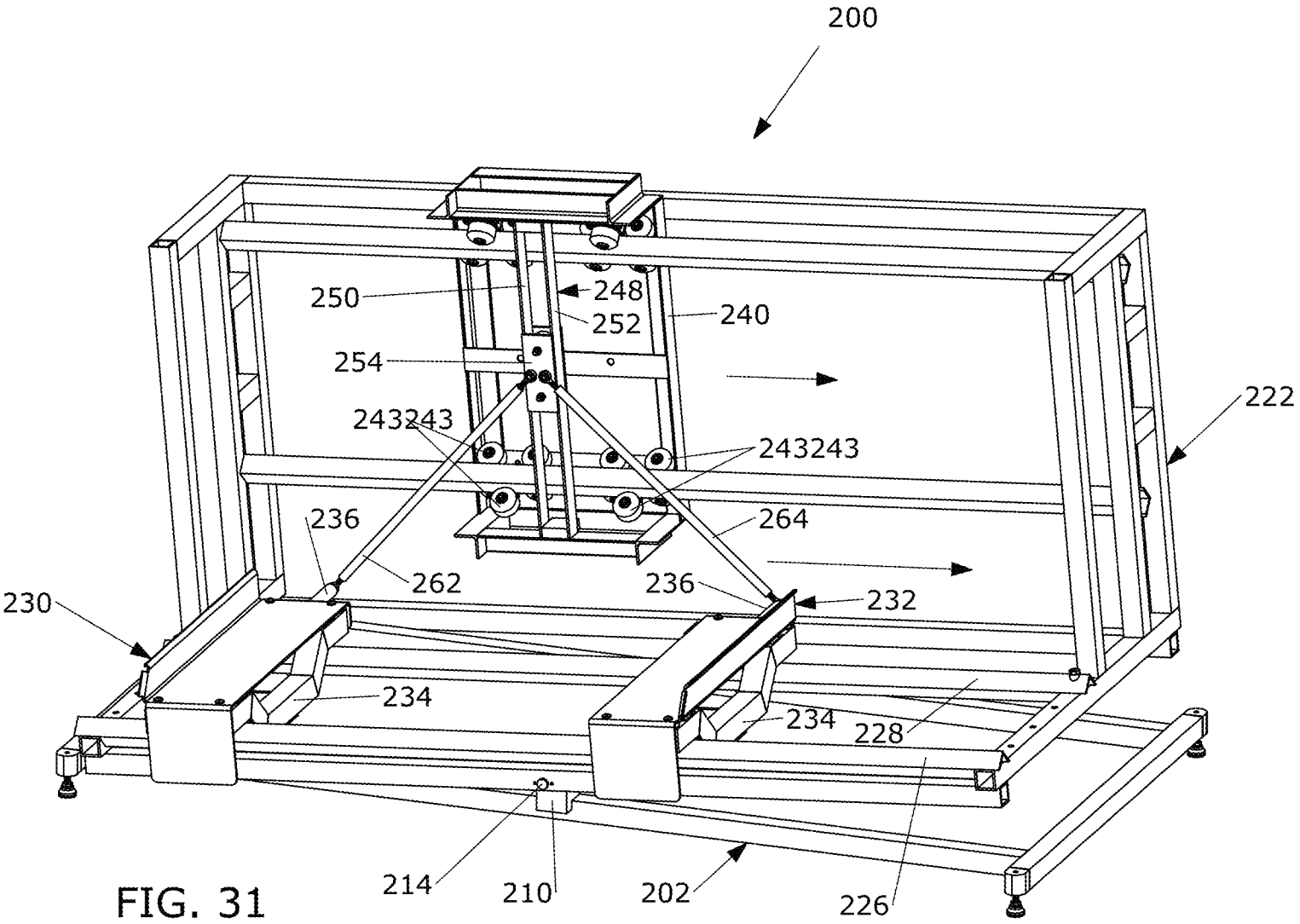
FIG. 31 is a perspective view of the second embodiment of the invention similar to FIG. 31, but with the foot supports and back support in having been moved during use of the exercise device.
Figure 32:
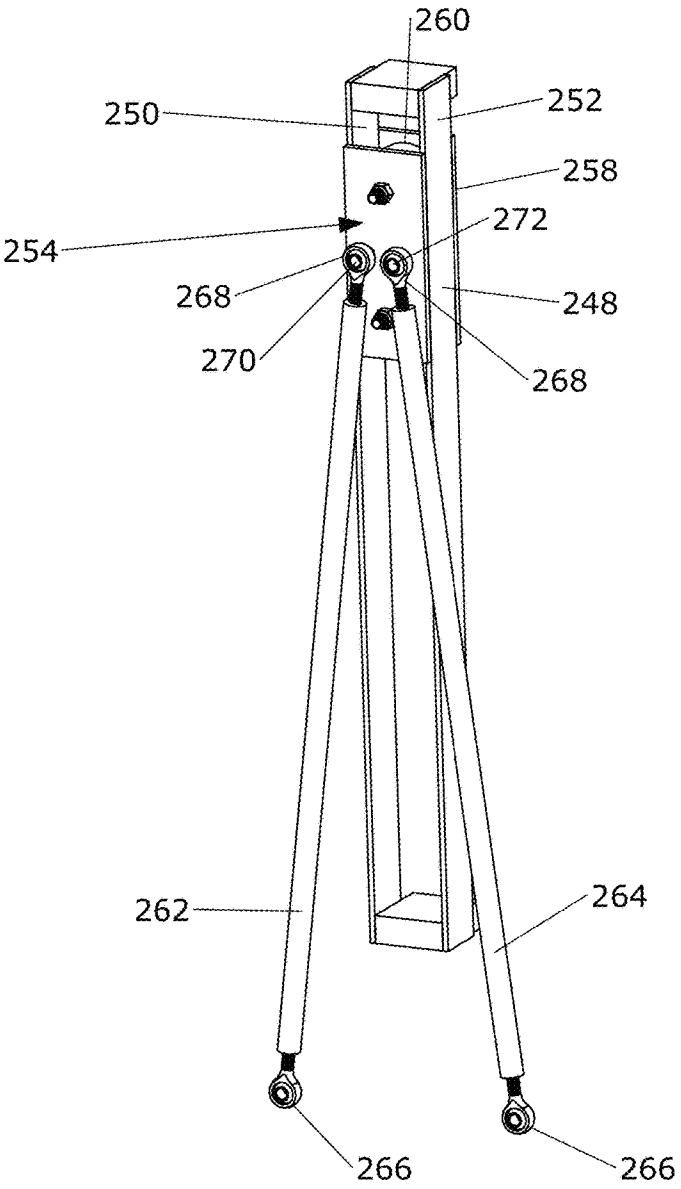
FIG. 32 is a perspective view showing the linkage system employed in the second embodiment of this invention in an orientation prior to commencement of an exercise.
Figure 33:
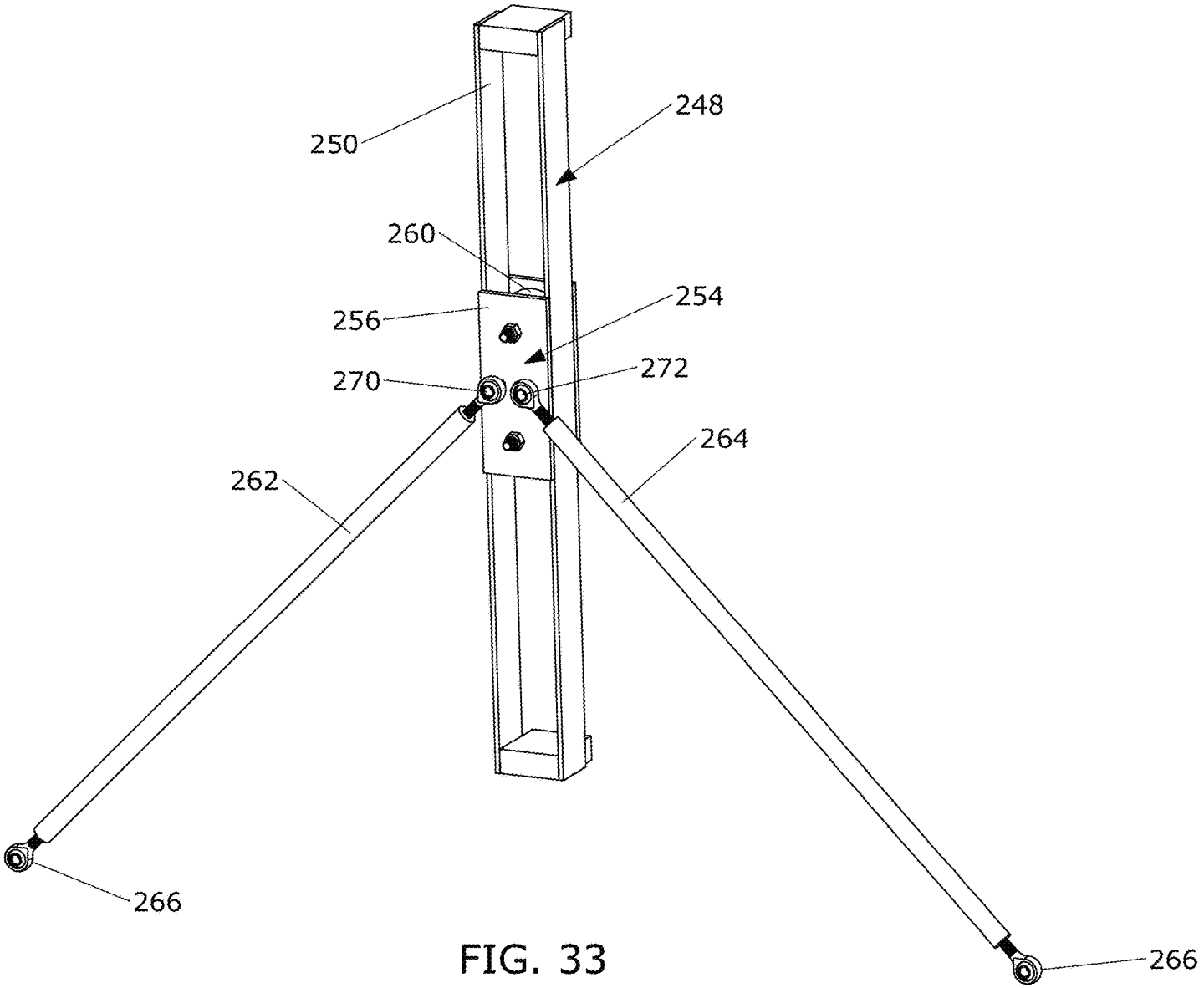
FIG. 33 is a perspective view showing the linkage system employed in the second embodiment of the invention showing the orientation of elements upon separation the foot supports during use of the exercise device.

Referring to FIGS. 30-33, a vertical assembly 248 is secured to a forward end of the rear frame or carriage 240 behind the back support 242. The vertical assembly 248 includes transversely spaced apart, vertical guide members 250, 252 supporting a mount 254 for vertical movement. Specifically, the mount 254 includes spaced apart plates 256, 258 bolted together through a spacer 260 and overlapping vertical guide members 250, 252 for vertical movement along said guide members. (FIG. 32).

Referring to FIGS. 30-33, a pair of links 262, 264 include lower ends rotatably connected to a respective connector 236 extending rearwardly from each foot support 230, 232 through bearings 266 threadedly connected to each link Bearings 268 also are threadedly connected at the upper ends of the link 262, 264 for receiving pins or axles 270, 272 that are fixed to the front plate 256 of mount 254 and extend outwardly or forwardly therefrom. By providing a threaded connection between bearings 266 and 268 on each of the links 262, 264, the degree of relative movement between the body engaging member 238 and the foot supports 230, 232 can be adjusted.

As described in connection with the position of elements in exercise device 10, the position of elements in exercise device 200 is with reference to a user situated on the device with his/her back engaging back support 242.

Referring to FIGS. 30 and 31, the foot supports 230, 232 and body engaging member 238 are shown in a starting position, with the foot supports 230 and body engaging member at the right end of the mounting member 222.

As can be seen in FIGS. 30 and 31, the right foot support 230 is positioned against the right part of the mounting member 222, which preferably is mounted for reciprocating movement relative to supporting base member 202. This is the same starting position as in the exercise device 10.

When a user starts a sliding exercise by pushing his/her right foot against the right foot support 230, the right foot support doesn't move. Rather the force imparted to the foot support 230 by the user provides an opposing, reaction force on the user, causing the user, as well as the body engaging member 238 to move to the left. Because the right link 262 is rotatably attached to both the right foot support 230 and the body engaging member 238 including the back support 242, the right link 262 likewise begins moving with the body engaging member 238. During this movement, the right link 262 rotates; causing, or pulling the mount 254 vertically downward (e.g., FIG. 31).

As can be seen in FIG. 31, as a result of the downward vertical movement of mount 254, the end of the left link 264 that is rotatably connected to the mount 254 also moves down; causing the left foot support 232 that is rotatably connected to the opposed end of the left link to move further to the left, away from the right foot support 230. As can be seen in FIG. 31, during this movement the right foot support 230 is still against the right end of the mounting member 222, and a reaction force in a direction opposite to that imparted by the user's right foot on the stationary right foot support 230 acts on the user to cause the body engaging member 238 and the left foot support 232 to move to the left.

During the above-described movement, the right foot support ultimately is moved to the left by its connection to link 262, and the body engaging member 238 and foot supports 230, 232 move uphill on the elongate guide rails 226, 228.

During continuous movement of the body engaging member 234 to the left, it passes over the pivot connection of the mounting member 222 to the base member 206; resulting in reciprocation of the mounting member 222 and the guide rails 226, 228 into a position in which the foot supports 230, 232 and the body engaging member 234 move in a downwardly inclined direction.

The user continues to move left until the left foot support 232 engages the left end of the mounting member 222 and the body engaging member 234 and right foot support 230 complete their movement to the left. Specifically, when the left foot support reaches the left end of the mounting member 222, the rotation of the left link 264 pushes the mount 254 vertically upward, which pulls the top end of the right link 262 up and the bottom end of the right link in a direction that moves the right foot support 230 to the left.

To move the foot supports from the left to the right, the above steps are provided in an opposite direction. For purposes of brevity, a discussion of the cooperation of the various elements as the foot supports and body engaging member are moved from left to right will not be discussed in detail. Individuals of ordinary skill in the art will understand the manner of reversing the steps employed to move the foot supports and body engaging member from right to left in order to move the foot supports and body engaging member from left to right.

In the exercise device 10, the links 152, 154 are mounted for linear movement relative to pins 170, 172 attached to the foot supports 38, 39. This results in the length of the link segment between the pins 170, 172, on the one hand, and the spaced, rotational mounts of the links (and gears) at the opposed end of the links, on the other hand, being varied, or changed during the sliding exercise.

In distinction, in exercise device 200, the links are not mounted for linear movement relative to their supporting axles, and the length of the link segment of each link between opposed rotatable mounts remains the same throughout the sliding exercise. Therefore, in order to permit proper operation of the linkage system in the exercise device 200 the pivotal mount of each link that is spaced from the pivotal mount of the respective link to the foot support is provided for vertical movement.

Therefore, in accordance with this invention either the links need to be linearly moveable on fixed axles to vary the length of the link segments between spaced apart axles connected to the foot supports and to the back engaging member, respectively, or axles rotatably supporting the links on the body engaging member need to be linearly moveable in a direction substantially normal to the longitudinal direction of movement of the foot supports and body engaging member during a sliding exercise.

For example, the linkage arrangement employing the moveable mount 254 in the exercise device 200 can be disposed in a horizontal plane, making it usable with the exercise device 10, if desired. If used horizontally the connector 238 extending rearwardly of the foot supports would be replaced with downwardly extending connectors or pins of the type employed on the foot supports 38, 39 in the exercise device 10.

Moreover, the linkage system 150 employed in the exercise device 10, which includes meshing gears or pulleys, can be disposed in a vertical orientation and used with the exercise device 200. In this arrangement the connectors extending rearwardly of the foot supports 232, 234 would be received within the elongate slots in the links 152, 154.

While the invention has been described in detail and with reference to specific examples thereof, it will be apparent to one skilled in the art that various changes and modifications can be made therein without departing from the spirit and scope thereof.

What is claimed is:

1. An exercise device including an elongate guide having a longitudinal dimension provided between spaced apart ends of said elongate guide, a pair of foot supports slidably mounted on and relative to the elongate guide for movement along said longitudinal dimension, a support adjacent to a side edge of said elongate guide for retaining a body engaging member, said body engaging member having a surface engageable by an individual using the device with feet of said individual in the foot supports and sliding along the longitudinal dimension of said elongate guide in opposite directions, whereby said body engaging member is adapted to support or stabilize the individual during movement of the individual as said individual moves along the longitudinal dimension of said elongate guide in each of said opposite directions; and a linkage system rotatably connected to the pair of foot supports and to the body engaging member through rotatable connections, said rotatable connections permitting interconnected movement of said body engaging member and said foot supports in a same longitudinal direction along the longitudinal dimension of the elongate guide.

2. The exercise device of claim 1, further including a connector connected to each of said pair of foot supports for movement with each of said pair of foot supports, said linkage system comprising a pair of elongate links, a first link of said pair of elongate links being rotatably connected through said rotatable connections at spaced apart locations thereon to the connector connected to a first foot support of said pair of foot supports and to the body engaging member, respectively, and a second link of said pair pair of elongate links being rotatably connected through said rotatable connections at spaced apart locations thereon to the connector connected to a second foot support of said pair of foot supports and to the body engaging member, respectively, said rotatable connections of said first and said second of said pair of links to said body engaging member being interconnected through moveable members to transmit rotational movement of one of said pair of elongate links to the other of said pair of elongate links about said connectors connected to the body engaging member upon relative movement between said first foot support of said pair of foot supports and said second foot support of said pair of foot supports or upon relative movement between the body engaging member and said first foot support of said pair of foot supports to provide interconnected movement of said body engaging member and said pair of foot supports in the same longitudinal direction along the same longitudinal direction of the elongate guide.

3. The exercise device of claim 2, each link of said pair of elongate links including a rail section at one end thereof, said connector connected to each of said first and second foot supports including a low friction member engageable with and movable along the rail section of a respective link when the respective link is being rotated as a result of said relative movement between the foot supports or as a result of said relative movement between said first foot support of said foot supports and said body engaging member.

4. The exercise device of claim 3, wherein each of said low friction members is a bushing or bearing engaging a rail section and slidably moveable thereon, each of said bushings or bearings being rotatably connected to and supported by a vertically extending member, said rotatable connection permitting rotation of said bushing or bearing in a horizontal plane, said vertically extending member adjacent an end spaced from an attachment to the bushing or bearing being mounted for movement with a respective foot support, whereby movement of each foot support relative to the body engaging member or relative to each other permits rotational movement of each of the bushings or bearings as said bushings or bearing slide along respective rail sections to which they are slidably mounted.

5. The exercise device of claim 3, wherein said rail section of each link is an elongate rod.

6. The exercise device of claim 3 wherein each of said low friction members is a bushing or bearing engaging the rail section of a corresponding link and moveable on said rail section, each of said bushings or bearings being rotatably connected to a vertically extending axle, each of said vertically extending axles being connected to move with a respective foot support, whereby movement of each foot support relative to the body engaging member or relative to the other foot support permits rotational movement of the bushings or bearings as said bushings or bearings slide along the rail section of links to which each bushing or bearing is slidably attached.

7. The exercise device of claim 2, wherein said moveable members include a pair of cooperating gears or a pair of cooperating pulleys connected, respectively, to rotate with the first and second links when said first and second links rotate relative to said body engaging member, said cooperating gears or cooperating pulleys being connected for transmitting rotational movement of each of said first and second links to said other of said first and second links.

8. The exercise device of claim 2, wherein said moveable members include a pair of cooperating gears or a pair of cooperating pulleys connected, respectively, to rotate with the first and second links when said first and second links rotate relative to said body engaging member, said cooperating gears or cooperating pulleys being connected for transmitting rotational movement of each of said first and second links to said other of said first and second links, each link including an elongate slot, said connector connected to each of said first and second foot supports being retained in a slot of a respective link and is moveable within the slot of the respective link when the respective link is being rotated as a result of said relative movement between the foot supports or as a result of said relative movement between said first foot support of said foot supports and said body engaging member.

9. The exercise device of claim 2, wherein said moveable members include a pair of cooperating gears or a pair of cooperating pulleys connected, respectively, to rotate with the first and second links when said first and second links rotate relative to said body engaging member, said cooperating gears or cooperating pulleys being connected for transmitting rotational movement of each of said first and second links to said other of said first and second links, each link including a rail section spaced from a respective meshing gear thereon, said connector connected to each of said first and second foot supports including a low friction member engageable with and movable along the rail section of a respective link when the respective link is being rotated as a result of said relative movement between the foot supports or as a result of said relative movement between said first foot support of said foot supports and said body engaging member.

10. The exercise device of claim 9, wherein each of said low friction members is a bushing or bearing engaging the rail section of the respective link and slidably moveable thereon, a vertically extending support connected adjacent one end thereof to move with a respective foot support and adjacent an end opposed to said one end to a respective bushing or bearing, said attachment to said bushings or bearings permitting rotational movement of said bushings or bearings in a plane perpendicular to the direction in which the vertically extending support extends, whereby movement of each foot support relative to the body engaging member or relative to each other permits the rotational movement of the bushing or bearing as it slides along rails sections of the respective elongated links.

11. The exercise device of claim 9, wherein said rail section of each link is an elongate rod.

12. The exercise device of claim 1, further including a mount for the elongate guide to permit reciprocating or rocking movement of the elongate guide for alternately permitting each of the spaced-apart ends to move upwardly and downwardly relative to a longitudinal support surface for the exercise device.

13. The exercise device of claim 1, wherein said body engaging member is a seating piece.

14. The exercise device of claim 1, wherein said body engaging member includes a back engaging member for engaging the back of an exerciser when said exerciser is in a standing position.

15. The exercise device of claim 1, further including a rotatably mounted, arm segment adjacent to each said spaced apart end of said elongate guide, each arm segment being rotatable between closed and open positions, said arm segments when in said closed position being in axial alignment, a connecting system configured to connect the arm segments together when in said closed position to prevent inadvertent movement of the arm segments into said open position, said arm segments when in said closed position being generally parallel to the longitudinal dimension of the elongate guide for overlying the body engaging member as said body engaging member is moving in said longitudinal direction between said spaced apart ends of said elongate guide to provide a continuous safety rail for the individual when in said closed position and a rail to be manually engaged by the individual to assist in propelling the individual along the elongate guide.

16. The exercise device of claim 1, further including a pair of rotatably mounted, elongate arm segments each adjacent to a respective spaced apart end of said elongate guide, each elongate arm segments being rotatable in a horizontal plane about a vertical axis and in a vertical plane about a horizontal axis substantially parallel to a direction of elongation of a respective elongate arm segment, whereby said elongate arm segments can be moved in said horizontal plane into a closed position overlying the body engaging member, or into positions substantially 90 degrees in either rotational direction from said closed position, wherein each of said elongate arm segments is a side rail.

17. The exercise device of claim 16, wherein each of said rotatably mounted elongate arm segments is rotatable in said vertical plane about said horizontal axis substantially parallel to the direction of elongation of said respective elongate arm segment to thereby position said arm segments closer or farther from the body engaging member.

18. The exercise device of claim 17, including locking means to retain each of the elongate arm segments in desired vertical and horizontal rotational position.

19. The exercise device of claim 1, said body engaging member being adjustable in mutually perpendicular directions.

20. The exercise device of claim 19, wherein adjustment of the body engaging member in one of said mutually perpendicular directions also adjusts the body engaging member in another of said mutually perpendicular positions.

21. The exercise device of claim 19, including a first adjustment means for adjusting the body engaging member in one of said mutually perpendicular directions and a second adjustment means for adjusting the body engaging member in another of said mutually perpendicular direction.

* * * * *